US010877388B2

(12) United States Patent
Aoki et al.

(10) Patent No.: US 10,877,388 B2
(45) Date of Patent: Dec. 29, 2020

(54) TONER

(71) Applicant: CANON KABUSHIKI KAISHA, Tokyo (JP)

(72) Inventors: Kenji Aoki, Numazu (JP); Takashi Matsui, Mishima (JP); Kenta Kamikura, Yokohama (JP); Masao Suzuki, Kawasaki (JP); Tsutomu Shimano, Mishima (JP); Reo Tagawa, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/438,553

(22) Filed: Jun. 12, 2019

(65) Prior Publication Data

US 2019/0384197 A1 Dec. 19, 2019

(30) Foreign Application Priority Data

Jun. 13, 2018 (JP) ..... 2018-113059
Apr. 10, 2019 (JP) ..... 2019-074941
May 20, 2019 (JP) ..... 2019-094515

(51) Int. Cl.
*G03G 9/08* (2006.01)
*G03G 9/087* (2006.01)

(52) U.S. Cl.
CPC ..... *G03G 9/08728* (2013.01); *G03G 9/0806* (2013.01); *G03G 9/0825* (2013.01)

(58) Field of Classification Search
CPC ..... G03G 9/08728; G03G 9/0806; G03G 9/0825; G03G 9/08797; G03G 9/08795; G03G 9/08782; G03G 9/08722; G03G 9/08731; G03G 9/08733; G03G 9/08711
USPC ..... 430/108.1, 109.1, 109.3, 109.31
See application file for complete search history.

(56) References Cited

U.S. PATENT DOCUMENTS 4,557,991 A * 12/1985 Takagiwa ..... G03G 9/08708 430/108.8
4,960,669 A 10/1990 Mori et al.
7,678,523 B2 3/2010 Hiroko et al.
7,842,446 B2 11/2010 Yanase et al.
7,923,190 B2 4/2011 Magome et al.
7,935,467 B2 5/2011 Dojo et al.
8,426,091 B2 4/2013 Magome et al.
8,426,094 B2 4/2013 Magome et al.
8,603,712 B2 12/2013 Aoki et al.
8,614,044 B2 12/2013 Matsui et al.
8,652,725 B2 2/2014 Watanabe et al.
8,741,519 B2 6/2014 Watanabe et al.
8,778,585 B2 7/2014 Matsui et al.
8,785,101 B2 7/2014 Kaya et al.
8,828,639 B2 9/2014 Kamikura et al.
8,841,054 B2 9/2014 Dojo et al.
8,846,284 B2 9/2014 Kinumatsu et al.
8,883,389 B2 11/2014 Matsui et al.
9,097,997 B2 8/2015 Nomura et al.
9,158,216 B2 10/2015 Shimano et al.
9,213,250 B2 12/2015 Nomura et al.
9,217,943 B2 12/2015 Matsui et al.
9,239,528 B2 1/2016 Hasegawa et al.
9,304,422 B2 4/2016 Matsui et al.
9,309,349 B2 4/2016 Watanabe et al.
9,348,246 B2 5/2016 Magome et al.
9,354,545 B2 5/2016 Matsui et al.
9,377,705 B2 6/2016 Shimano et al.
9,383,668 B2 7/2016 Noji et al.
9,429,860 B2 8/2016 Kinumatsu et al.
9,442,416 B2 9/2016 Magome et al.
9,442,419 B2 9/2016 Wakabayashi et al.
9,500,972 B2 11/2016 Tanaka et al.
9,575,424 B2 2/2017 Nakagawa et al.
9,581,934 B2 2/2017 Ito et al.
9,599,919 B2 3/2017 Isono et al.
9,625,844 B2 4/2017 Kaya et al.
9,658,546 B2 5/2017 Tanaka et al.
(Continued)

FOREIGN PATENT DOCUMENTS

EP 0 703 505 3/1996
EP 0 744 668 11/1996
(Continued)

OTHER PUBLICATIONS

U.S. Appl. No. 16/438,537, filed Jun. 12, 2019, Kentaro Kamae.
U.S. Appl. No. 16/438,541, filed Jun. 12, 2019, Takeshi Hashimoto.
U.S. Appl. No. 16/438,544, filed Jun. 12, 2019, Kazuhisa Shirayama.
U.S. Appl. No. 16/438,545, filed Jun. 12, 2019, Kenta Kamikura.
U.S. Appl. No. 16/438,566, filed Jun. 12, 2019, Takashi Matsui.
U.S. Appl. No. 16/438,605, filed Jun. 12, 2019, Daisuke Yoshiba.
U.S. Appl. No. 16/438,611, filed Jun. 12, 2019, Hiroki Kagawa.
(Continued)

*Primary Examiner* — Mark A Chapman
(74) *Attorney, Agent, or Firm* — Venable LLP

(57) ABSTRACT

A toner, including a toner particle that contains a binder resin and a release agent, wherein the binder resin contains a polymer A, the polymer A including a first monomer unit derived from a first polymerizable monomer and a second monomer unit derived from a second polymerizable monomer different from the first polymerizable monomer; the first polymerizable monomer is selected from (meth)acrylic acid esters having a $C_{18-36}$ alkyl group; the toner has a first monomer unit content and a second monomer unit content in the polymer A which are within specific ranges, and assuming that an SP value of the first monomer unit is taken as $SP_{11}$ and an SP value of the second monomer unit is taken as $SP_{21}$, the formula (1) below is satisfied, and the molecular weight of the release agent is at least 1,000.

$$3.00 \leq (SP_{21} - SP_{11}) \leq 25.00 \quad (1)$$

9 Claims, No Drawings

(56) References Cited

U.S. PATENT DOCUMENTS

| | | | | |
|---|---|---|---|---|
| 9,658,554 | B2 | 5/2017 | Kinumatsu et al. | |
| 9,785,071 | B2 | 10/2017 | Shimano et al. | |
| 9,798,256 | B2 | 10/2017 | Kosaki et al. | |
| 9,798,262 | B2 | 10/2017 | Toyoizumi et al. | |
| 9,811,016 | B2 | 11/2017 | Aoki et al. | |
| 9,823,595 | B2 | 11/2017 | Toyoizumi et al. | |
| 9,829,816 | B2 | 11/2017 | Tanaka et al. | |
| 9,835,964 | B2 | 12/2017 | Yoshida et al. | |
| 9,857,707 | B2 | 1/2018 | Tsuda et al. | |
| 9,857,713 | B2 | 1/2018 | Kosaki et al. | |
| 9,869,943 | B2 | 1/2018 | Aoki et al. | |
| 9,880,478 | B2 | 1/2018 | Shimano et al. | |
| 9,904,195 | B2 | 2/2018 | Matsui et al. | |
| 9,921,501 | B2 | 3/2018 | Mochizuki et al. | |
| 9,952,523 | B2 | 4/2018 | Shimano et al. | |
| 9,958,801 | B2 | 5/2018 | Tanaka et al. | |
| 10,012,919 | B2 | 7/2018 | Matsui et al. | |
| 10,078,279 | B2 | 9/2018 | Nakagawa et al. | |
| 10,101,681 | B2 | 10/2018 | Tagawa et al. | |
| 10,114,303 | B2 | 10/2018 | Katsura et al. | |
| 10,151,990 | B2 | 12/2018 | Suzuki et al. | |
| 10,156,800 | B2 | 12/2018 | Tsuda et al. | |
| 10,197,934 | B2 | 2/2019 | Matsui et al. | |
| 10,216,107 | B2 | 2/2019 | Tsubaki et al. | |
| 10,241,430 | B2 | 3/2019 | Kimura et al. | |
| 10,303,074 | B2 | 5/2019 | Yamawaki et al. | |
| 10,310,396 | B2 | 6/2019 | Kamikura et al. | |
| 10,338,487 | B2 | 7/2019 | Kamikura et al. | |
| 10,345,726 | B2 | 7/2019 | Nakamura et al. | |
| 10,353,308 | B2 | 7/2019 | Hatakeyama et al. | |
| 10,401,750 | B2 | 9/2019 | Nakamura et al. | |
| 10,409,180 | B2 | 9/2019 | Koji et al. | |
| 2002/0055050 | A1* | 5/2002 | Serizawa | G03G 9/08782 430/108.4 |
| 2004/0110077 | A1* | 6/2004 | Yachi | C09C 1/3081 430/108.6 |
| 2004/0185367 | A1 | 9/2004 | Serizawa et al. | |
| 2006/0269858 | A1* | 11/2006 | McDougall | G03G 9/08793 430/106.1 |
| 2007/0166636 | A1* | 7/2007 | Daimon | G03G 9/0825 430/109.3 |
| 2009/0087768 | A1 | 4/2009 | Tosaka et al. | |
| 2009/0197192 | A1 | 8/2009 | Hiroko et al. | |
| 2013/0202998 | A1 | 8/2013 | Higashi et al. | |
| 2014/0038098 | A1 | 2/2014 | Naka et al. | |
| 2014/0120465 | A1* | 5/2014 | Watanabe | G03G 9/081 430/108.2 |
| 2014/0272699 | A1 | 9/2014 | Minaki et al. | |
| 2014/0308611 | A1 | 10/2014 | Shimano et al. | |
| 2015/0185658 | A1 | 7/2015 | Wakabayashi et al. | |
| 2017/0045834 | A1 | 2/2017 | Shirai et al. | |
| 2017/0269496 | A1 | 9/2017 | Kubo et al. | |
| 2018/0143557 | A1 | 5/2018 | Ueda et al. | |
| 2018/0329320 | A1 | 11/2018 | Yoshida et al. | |
| 2018/0329328 | A1 | 11/2018 | Tanaka et al. | |
| 2018/0329332 | A1 | 11/2018 | Tominaga et al. | |
| 2019/0137900 | A1 | 5/2019 | Nakagawa et al. | |
| 2019/0137901 | A1 | 5/2019 | Shimano et al. | |
| 2019/0235403 | A1 | 8/2019 | Tanaka et al. | |
| 2019/0235404 | A1 | 8/2019 | Kamikura et al. | |
| 2019/0235407 | A1 | 8/2019 | Nakamura et al. | |

FOREIGN PATENT DOCUMENTS

| | | |
|---|---|---|
| EP | 1 494 087 | 1/2005 |
| EP | 2 626 745 | 8/2013 |
| EP | 2 843 473 | 3/2015 |
| JP | 2000-250264 | 9/2000 |
| JP | 2009-265644 | 11/2009 |
| JP | 2011-094137 | 5/2011 |
| JP | 2013-228724 | 11/2013 |
| JP | 2014-130243 | 7/2014 |
| JP | 2014-222259 | 11/2014 |

OTHER PUBLICATIONS

Fedors, "A Method for Estimating Both the Solubility Parameters and Molar Volumes of Liquids", Polymer Engineering and Science, vol. 14, No. 2 (1974) 147-54.

U.S. Appl. No. 16/438,623, filed Jun. 12, 2019, Tatsuya Saeki.

U.S. Appl. No. 16/525,993, filed Jul. 30, 2019, Tsutomu Shimano.

* cited by examiner

TONER

BACKGROUND OF THE INVENTION

Field of the Invention

The present invention relates to a toner for use in electrophotographic methods, electrostatic recording methods and toner jet recording methods.

Description of the Related Art

In recent years, energy saving is considered a serious technical issue for electrophotographic apparatuses, and significant reductions in the amount of heat applied the fixing unit are being studied. In particular, there is increased demand for toners with the property of "low-temperature fixability", which allows fixing with lower energy.

One way to enable fixing at low temperatures is to lower the glass transition temperature (Tg) of the binder resin in the toner. However, because the heat-resistant storage stability of the toner declines when the Tg is reduced, it is difficult to obtain a toner with both low-temperature fixability and heat-resistant storage stability by these methods.

Therefore, methods using crystalline vinyl resins as binder resins are being studied in an effort to give toners both low-temperature fixability and heat-resistant storage stability. The amorphous resins commonly used as toner binder resins do not exhibit clear endothermic peaks in differential scanning calorimetry (DSC), but an endothermic peak appears in DSC measurement when a crystalline resin component is included. Crystalline vinyl resins have the property of hardly softening at all up to the melting point because the side chains in the molecule are regularly arranged.

Crystals also melt suddenly at the melting point, accompanied by a rapid drop in viscosity. They are therefore of interest as materials with excellent sharp-melt properties that provide both low-temperature fixability and heat-resistant storage stability. Normally, crystalline vinyl resins have long-chain alkyl groups as side chains of the main chain skeleton, and exhibit crystallinity as resins because the long-chain alkyl groups of the side chains crystallize with each other.

Japanese Patent Application No. 2009-265644 proposes a toner with excellent low-temperature fixability using a crystalline vinyl resin with an introduced crosslinked structure.

Japanese Patent Application No. 2014-130243 proposes a toner having a core comprising a crystalline vinyl resin obtained by copolymerizing an amorphous polymerizable monomer with a polymerizable monomer having a long-chain alkyl group. This aims at achieving both low-temperature fixability and heat-resistant storage stability.

SUMMARY OF THE INVENTION

However, the toner of Japanese Patent Application No. 2009-265644 uses a crystalline vinyl resin obtained by copolymerizing only a crosslinking agent and a polymerizable monomer having a long-chain alkyl group, and was found to have poor durability because elasticity was low near room temperature. This configuration also does not use a release agent, and winding around the fixing unit has been found to occur during fixing.

In Japanese Patent Application No. 2014-130243, durability has also been found to be poor because elasticity is low near room temperature due to the large proportion of the polymerizable monomer having a long-chain alkyl group. Winding around the fixing unit was also found to be likely when printing with a high print percentage. The reason for this is believed to be that crystalline vinyl resins are ordinarily highly hydrophobic, and because the release agent has a low molecular weight it melts into the crystalline vinyl resin and can no longer provide a release effect during fixing. Heat-resistant storage stability was also found to decline because the melting of the release agent into the crystalline vinyl resin disrupts the crystallinity of the crystalline vinyl resin.

For these reasons, there is a need for further improvements in order to achieve a toner with excellent low-temperature fixability and heat-resistant storage stability as well as excellent durability and release properties.

In light of the problems discussed above, the present invention provides a toner with excellent low-temperature fixability and heat-resistant storage stability as well as excellent durability and release properties.

To solve these problems, the present invention provides the following:

a toner comprising a toner particle containing a binder resin and a release agent, wherein the binder resin contains a polymer A having a first monomer unit derived from a first polymerizable monomer and a second monomer unit derived from a second polymerizable monomer different from the first polymerizable monomer, the first polymerizable monomer is at least one selected from the group consisting of (meth)acrylic acid esters having a $C_{18-36}$ alkyl group, the content of the first monomer unit in the polymer A is 5.0 mol % to 60.0 mol % of the total moles of all monomer units in the polymer A, the content of the second monomer unit in the polymer A is 20.0 mol % to 95.0 mol % of the total moles of all monomer units in the polymer A, when the SP value of the first monomer unit is $SP_{11}$ $(J/cm^3)^{0.5}$ and the SP value of the second monomer unit is $SP_{21}$ $(J/cm^3)^{0.5}$, the following formula (1) is satisfied; and the molecular weight of the release agent is at least 1,000.

$$3.00 \leq (SP_{21} - SP_{11}) \leq 25.00 \quad (1)$$

The present invention also provides a toner comprising a toner particle containing a binder resin and a release agent, wherein the binder resin contains a polymer A that is a polymer of a composition containing a first polymerizable monomer and a second polymerizable monomer different from the first polymerizable monomer, the first polymerizable monomer is at least one selected from the group consisting of (meth)acrylic acid esters having a $C_{18-36}$ alkyl group, the content of the first polymerizable monomer in the composition is 5.0 mol % to 60.0 mol % of the total moles of all polymerizable monomers in the composition, the content of the second polymerizable monomer in the composition is 20.0 mol % to 95.0 mol % of the total moles of all polymerizable monomers in the composition, when the SP value of the first polymerizable monomer is $SP_{12}$ $(J/cm^3)^{0.5}$, and the SP value of the second polymerizable monomer is $SP_{22}$ $(J/cm^3)^{0.5}$, the following formula (2) is satisfied, and the molecular weight of the release agent is at least 1,000.

$$0.60 \leq (SP_{22} - SP_{12}) \leq 15.00 \quad (2)$$

The present invention can provide a toner with excellent low-temperature fixability and heat-resistant storage stability as well as excellent durability and release properties.

Further features of the present invention will become apparent from the following description of exemplary embodiments.

DESCRIPTION OF THE EMBODIMENTS

Unless otherwise specified, descriptions of numerical ranges such as "from X to Y" or "X to Y" in the present invention include the numbers at the upper and lower limits of the range.

In the present invention, a (meth)acrylic acid ester means an acrylic acid ester and/or a methacrylic acid ester.

A "monomer unit" in the present invention is defined as one carbon-carbon bonded section in a principal chain composed of polymerized vinyl monomers in a polymer. A vinyl monomer can be represented by the following formula (C):

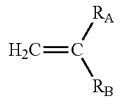

(C)

[in formula (C), $R_A$ represents a hydrogen atom or an alkyl group (preferably a $C_{1-3}$ alkyl group, or more preferably a methyl group), and $R_B$ represents any substituent].

A crystalline resin is a resin that exhibits a clear endothermic peak in differential scanning calorimetry (DSC).

A crystalline vinyl resin normally has long-chain alkyl groups as side chains of the main chain skeleton, and exhibits crystallinity as a resin because the long-chain alkyl groups of the side chains crystallize with each other. Consequently, when using a crystalline vinyl resin having long-chain alkyl groups, the degree of crystallinity is greater and the melting point is higher the greater the proportion of long-chain alkyl groups. This also produces a sharp-melt property and excellent low-temperature fixability. However, as the proportion of long-chain alkyl groups rises the elasticity of the crystalline vinyl resin near room temperature is reduced, making the toner fragile and less durable.

If the proportion of long-chain alkyl groups is reduced by copolymerization with another monomer in an effort to improve durability, however, crystallinity declines dramatically, and the melting point is reduced. Heat-resistant storage stability is likely to decline as a result, and the sharp-melt property and low-temperature fixability are also adversely affected.

Furthermore, because a crystalline vinyl resin having many long-chain alkyl groups generally has low polarity and strong affinity for common release agents, the release agent is likely to be compatible with the crystalline vinyl resin. This makes the release agent less likely to be exuded onto the surface of the toner particle during fixing, detracting from the release properties.

To resolve these problems, the inventors arrived at the present invention as a result of intensive studies into the types and amounts of monomer units having long-chain alkyl groups and the types and amounts of other monomer units in polymers used in binder resins, as well as differences in SP values of these monomer units, and the molecular weight of the release agent.

The present invention relates to a toner comprising a toner particle containing a binder resin and a release agent, wherein the binder resin contains a polymer A having a first monomer unit derived from a first polymerizable monomer and a second monomer unit derived from a second polymerizable monomer different from the first polymerizable monomer, the first polymerizable monomer is at least one selected from the group consisting of (meth)acrylic acid esters having a $C_{18-36}$ alkyl group, the content of the first monomer unit in the polymer A is 5.0 mol % to 60.0 mol % of the total moles of all monomer units in the polymer A, the content of the second monomer unit in the polymer A is 20.0 mol % to 95.0 mol % of the total moles of all monomer units in the polymer A, when the SP value of the first monomer unit is $SP_{11}$ $(J/cm^3)^{0.5}$ and the SP value of the second monomer unit is $SP_{21}$ $(J/cm^3)^{0.5}$, the following formula (1) is satisfied; and the molecular weight of the release agent is at least 1,000.

$$3.00 \leq (SP_{21} - SP_{11}) \leq 25.00 \quad (1)$$

The present invention is also a toner comprising a toner particle containing a binder resin and a release agent, wherein the binder resin contains a polymer A that is a polymer of a composition containing a first polymerizable monomer and a second polymerizable monomer different from the first polymerizable monomer, the first polymerizable monomer is at least one selected from the group consisting of (meth)acrylic acid esters having a $C_{18-36}$ alkyl group, the content of the first polymerizable monomer in the composition is 5.0 mol % to 60.0 mol % of the total moles of all polymerizable monomers in the composition, the content of the second polymerizable monomer in the composition is 20.0 mol % to 95.0 mol % of the total moles of all polymerizable monomers in the composition, when the SP value of the first polymerizable monomer is $SP_{12}$ $(J/cm^3)$", and the SP value of the second polymerizable monomer is $SP_{22}$ $(J/cm^3)$", the following formula (2) is satisfied, and the molecular weight of the release agent is at least 1,000.

$$0.60 \leq (SP_{22} - SP_{12}) \leq 15.00 \quad (2)$$

The "SP" value here is an abbreviation for a solubility parameter, and is used as an indicator of solubility. The calculation methods are described below.

In the present invention, the binder resin contains a polymer A. The polymer A has a first monomer unit derived from a first polymerizable monomer and a second monomer unit derived from a second polymerizable monomer that is different from the first polymerizable monomer. The first polymerizable monomer is at least one selected from the group consisting of the (meth)acrylic acid esters having a $C_{18-36}$ alkyl group. Because it has the first monomer unit, the polymer A becomes a resin exhibiting crystallinity.

The polymer A includes a first monomer unit derived from a first polymerizable monomer and a second monomer unit derived from a second polymerizable monomer that is different from the first polymerizable monomer, and assuming that the SP value of the first monomer unit is taken as $SP_{11}$ $(J/cm^3)^{0.5}$ and the SP value of the second monomer unit is taken as $SP_{21}$ $(J/cm^3)^{0.5}$, the polymer A satisfies the formula (1) below.

Furthermore, assuming that the SP value of the first polymerizable monomer is taken as $SP_{12}$ $(J/cm^3)^{0.5}$ and the SP value of the second polymerizable monomer is taken as $SP_{22}$ $(J/cm^3)^{0.5}$, the polymer A satisfies the formula (2) below.

$$3.00 \leq (SP_{21} - SP_{11}) \leq 25.00 \quad (1)$$

$$0.60 \leq (SP_{22} - SP_{12}) \leq 15.00 \quad (2)$$

The SP value in the invention is given in units of $(J/m^3)^{0.5}$, but this can be converted to units of $(cal/cm^3)^{0.5}$ using the formula 1 $(cal/cm^{-3})^{0.5} = 2.045 \times 10^3$ $(J/m^3)^{0.5}$.

If the formula (1) or formula (2) above is satisfied, the melting point is maintained without lowering the crystallinity of the polymer A. It is thus possible to achieve both low-temperature fixability and heat-resistant storage stability. The mechanism for this is believed to be as follows.

Crystallinity is expressed when the first monomer unit is incorporated into the polymer and the first monomer units aggregate together, but when other monomer units are incorporated, they normally inhibit crystallization, making it more difficult to obtain a crystalline polymer. This tendency is particularly evident when the first monomer units and other monomer units bond randomly in a single molecule of the polymer.

In the present invention, however, it is thought that because the polymer is constituted using polymerizable monomers such that $SP_{22}-SP_{12}$ is within the range of formula (2) above, the first polymerizable monomer and second polymerizable monomer can bond continuously to a certain degree rather than bonding randomly during polymerization. This means that the first monomer units can aggregate together in the polymer A, so that even if other monomer units are incorporated the crystallinity can still be increased and the melting point can be maintained. That is, the polymer A preferably has crystalline segments containing first monomer units derived from the first polymerizable monomer. Furthermore, the polymer A preferably has amorphous segments containing second monomer units derived from the second polymerizable monomer.

Furthermore, it is thought that if $SP_{21}-SP_{11}$ is within the aforementioned range as represented by formula (1), it is possible to form a clear phase separation state without mutual dissolution of the first monomer unit and second monomer unit in the polymer A, so that crystallinity is not reduced and the melting point is maintained.

If $SP_{22}-SP_{12}$ is less than 0.60, the melting point of the polymer A is reduced, and heat-resistant storage stability declines. If it exceeds 15.00, on the contrary, it is thought that the copolymerizability of the polymer A will be poor, resulting in non-uniformity and a decrease in low-temperature fixability. The lower limit of $SP_{22}-SP_{12}$ is preferably at least 2.00, or more preferably at least 3.00. The upper limit is preferably not more than 10.00, or more preferably not more than 7.00.

Similarly, if $SP_{21}-SP_{11}$ is less than 3.00 the melting point of the polymer A is reduced, and heat-resistant storage stability declines. If it exceeds 25.00, on the contrary, it is thought that the copolymerizability of the polymer A is poor, resulting in non-uniformity and a decrease in low-temperature fixability. The lower limit of $SP_{21}-SP_{11}$ is preferably at least 4.00, or more preferably at least 5.00. The upper limit is preferably not more than 20.00, or more preferably not more than 15.00.

When multiple kinds of monomer units fulfilling the conditions for the first monomer unit are present in the polymer A in the present invention, the value of $SP_{11}$ in formula (1) is a weighted average of the SP values of each of these monomer units. For example, if a monomer unit A with an SP value of $SP_{111}$ is included in the amount of A mol % based on the total moles of the monomer units fulfilling the conditions for the first monomer unit and a monomer unit B with an SP value of $SP_{112}$ is included in the amount of (100−A) mol % based on the total moles of the monomer units fulfilling the conditions for the first monomer unit, the SP value $(SP_{11})$ is:

$$SP_{11} = (SP_{111} \times A + SP_{112} \times (100 - A))/100.$$

The calculation is similar when three or more monomer units fulfilling the conditions for the first monomer unit are included. Similarly, $SP_{12}$ also represents an average value calculated based on the molar ratios of each of the first polymerizable monomers.

Moreover, the monomer unit derived from the second polymerizable monomer corresponds to all monomer units having $SP_{21}$ values satisfying the formula (1) in combination with the $SP_{11}$ value calculated by the methods described above. Similarly, the second polymerizable monomer corresponds to all polymerizable monomers having $SP_{22}$ values satisfying the formula (2) in combination with the $SP_{12}$ value calculated by the methods described above.

That is, when the second polymerizable monomer is two or more kinds of polymerizable monomer, $SP_{21}$ represents the SP values of monomer units derived from each of the polymerizable monomers, and $SP_{21}-SP_{11}$ is determined for the monomer units derived from each of the second polymerizable monomers. Similarly, $SP_{22}$ represents the SP values of each of the polymerizable monomers, and $SP_{22}-SP_{12}$ is determined for each of the second polymerizable monomers.

The first monomer unit content in the polymer A is from 5.0 mol % to 60.0 mol % of the total moles of all monomer units in the polymer A, and the second monomer unit content in the polymer A is from 20.0 mol % to 95.0 mol % of the total moles of all monomer units in the polymer A.

Moreover, the polymer A is a polymer derived from a composition containing a first polymerizable monomer and a second polymerizable monomer that is different from the first polymerizable monomer. The first polymerizable monomer content in the composition is from 5.0 mol % to 60.0 mol % of the total moles of all polymerizable monomers in the composition, and the second polymerizable monomer content in the composition is from 20.0 mol % to 95.0 mol % of the total moles of all polymerizable monomers in the composition.

If the first monomer unit content in the polymer A and the first polymerizable monomer content in the composition are within the above ranges, the polymer A acquires a sharp-melt property, and the resulting toner has excellent low-temperature fixability. If the content is less than 5.0 mol %, there are fewer crystals of the polymer A, and the sharp-melt property is reduced, resulting in lower low-temperature fixability. If the content exceeds 60.0 mol %, on the contrary, elasticity near room temperature declines, adversely affecting the durability of the toner.

The first monomer unit content in the polymer A and the first polymerizable monomer content in the composition are preferably from 10.0 mol % to 60.0 mol %, or more preferably from 20.0 mol % to 40.0 mol %.

When the polymer A has two or more monomer units derived from (meth)acrylic acid esters having a $C_{18-36}$ alkyl group, the first monomer unit content represents the molar ratio of the total of these monomer units. Moreover, when the composition used for the polymer A contains two or more kinds of (meth)acrylic acid esters having a $C_{18-36}$ alkyl group, the first polymerizable monomer content represents the molar ratio of the total of these polymerizable monomers.

If the second monomer unit content in the polymer A and the second polymerizable monomer content in the composition are within the above ranges, the elasticity of the polymer A near room temperature is improved, resulting in a highly durable toner. The melting point can also be maintained because crystallization of the first monomer unit in the polymer A is not inhibited.

If the content is less than 20.0 mol %, the polymer A becomes less elastic, and the toner becomes less durable. If the content exceeds 95.0 mol %, the sharp-melt property of the polymer A declines, adversely affecting low-temperature fixability. The preferred range of the second monomer unit content in the polymer A and the second polymerizable monomer content in the composition is from 40.0 mol % to 95.0 mol %, or more preferably from 40.0 mol % to 70.0 mol %.

When two or more kinds of monomer units derived from second polymerizable monomers satisfying the formula (1) are present in the polymer A, the second monomer unit content represents the molar ratio of the total of these monomer units. Moreover, when the composition used for the polymer A contains two or more kinds of second polymerizable monomers, the second polymerizable monomer content represents the molar ratio of the total of these polymerizable monomers.

The first polymerizable monomer is at least one selected from the group consisting of (meth)acrylic acid esters having a $C_{18-36}$ alkyl group.

Examples of (meth)acrylic acid esters having a $C_{18-36}$ alkyl group include (meth)acrylic acid esters having a $C_{18-36}$ straight-chain alkyl group [stearyl (meth)acrylate, nonadecyl (meth)acrylate, eicosyl (meth)acrylate, heneicosanyl (meth)acrylate, behenyl (meth)acrylate, lignoceryl (meth) acrylate, ceryl (meth)acrylate, octacosyl (meth)acrylate, myricyl (meth)acrylate, dotriacontyl (meth)acrylate, etc.] and (meth)acrylic acid esters having a $C_{18-36}$ branched alkyl group [2-decyltetradecyl (meth)acrylate, etc.].

Of these, at least one selected from the group consisting of (meth)acrylic acid esters having a $C_{18-36}$ straight-chain alkyl group is preferred from the standpoint of the storage stability of the toner, at least one selected from the group consisting of the (meth)acrylic acid esters having a $C_{18-30}$ straight-chain alkyl group is more preferred, and at least one selected from the group consisting of straight-chain stearyl (meth)acrylate and behenyl (meth)acrylate is still more preferred.

One kind alone or a combination of two or more kinds may be used for the first polymerizable monomer.

Of those given below for example, a polymerizable monomer conforming to the formula (1) or (2) may be used as the second polymerizable monomer.

One kind of monomer alone or a combination of two or more kinds may be used for the second polymerizable monomer.

Monomers having nitrile groups: for example, acrylonitrile, methacrylonitrile and the like.

Monomers having hydroxy groups: for example, 2-hydroxyethyl (meth)acrylate, 2-hydroxypropyl (meth)acrylate, and the like.

Monomers having amide groups: for example, acrylamide and monomers obtained by reacting $C_{1-30}$ amines with $C_{2-30}$ carboxylic acids having ethylenically unsaturated bonds (acrylic acid, methacrylic acid, etc.) by known methods.

Monomers having urethane groups: for example, monomers obtained by reacting $C_{2-22}$ alcohols having ethylenically unsaturated bonds (2-hydroxyethyl methacrylate, vinyl alcohol, etc.) by known methods with $C_{1-30}$ isocyanates [monoisocyanate compounds (benzenesulfonyl isocyanate, tosyl isocyanate, phenyl isocyanate, p-chlorophenyl isocyanate, butyl isocyanate, hexyl isocyanate, t-butyl isocyanate, cyclohexyl isocyanate, octyl isocyanate, 2-ethylhexyl isocyanate, dodecyl isocyanate, adamantyl isocyanate, 2,6-dimethylphenyl isocyanate, 3,5-dimethylphenyl isocyanate and 2,6-dipropylphenyl isocyanate, etc.), aliphatic diisocyanate compounds (trimethylene diisocyanate, tetramethylene diisocyanate, hexamethylene diisocyanate, pentamethylene diisocyanate, 1,2-propylene diisocyanate, 1,3-butylene diisocyanate, dodecamethylene diisocyanate and 2,4,4-trimethylhexamethylene diisocyanate, etc.), alicyclic diisocyanate compounds (1,3-cyclopentene diisocyanate, 1,3-cyclohexane diisocyanate, 1,4-cyclohexane diisocyanate, isophorone diisocyanate, hydrogenated diphenylmethane diisocyanate, hydrogenated xylylene diisocyanate, hydrogenated tolylene diisocyanate and hydrogenated tetramethylxylylene diisocyanate, etc.) and aromatic diisocyanate compounds (phenylene diisocyanate, 2,4-tolylene diisocyanate, 2,6-tolylene diisocyanate, 2,2'-diphenylmethane diisocyanate, 4,4'-diphenylmethane diisocyanate, 4,4'-toluidine diisocyanate, 4,4'-diphenyl ether diisocyanate, 4,4'-diphenyl diisocyanate, 1,5-naphthalene diisocyanate and xylylene diisocyanate, etc.) and the like], and monomers obtained by reacting $C_{1-26}$ alcohols (methanol, ethanol, propanol, isopropyl alcohol, butanol, t-butyl alcohol, pentanol, heptanol, octanol, 2-ethylhexanol, nonanol, decanol, undecyl alcohol, lauryl alcohol, dodecyl alcohol, myristyl alcohol, pentadecyl alcohol, cetanol, heptadecanol, stearyl alcohol, isostearyl alcohol, elaidyl alcohol, oleyl alcohol, linoleyl alcohol, linolenyl alcohol, nonadecyl alcohol, heneicosanol, behenyl alcohol, erucyl alcohol, etc.) by known methods with $C_{2-30}$ isocyanates having ethylenically unsaturated bonds [2-isocyanatoethyl (meth)acrylate, 2-(0-[1'-methylpropylidenamino]carboxyamino) ethyl (meth) acrylate, 2-[(3,5-dimethylpyrazolyl)carbonylamino] ethyl (meth)acrylate and 1,1-(bis(meth)acryloyloxymethyl) ethyl isocyanate, etc.] and the like.

Monomers having urea groups: for example, monomers obtained by reacting $C_{3-22}$ amines [primary amines (normal butylamine, t-butylamine, propylamine, and isopropylamine, etc.), secondary amines (di-normal ethylamine, di-normal propylamine, di-normal butylamine, etc.), anilines, cycloxylamines and the like] by known methods with $C_{2-30}$ isocyanates having ethylenically unsaturated bonds and the like.

Monomers having carboxyl groups: for example, methacrylic acid, acrylic acid, 2-carboxyethyl (meth)acrylate.

Of these, it is desirable to use a monomer having a nitrile, amide, urethane, hydroxy or urea group. A monomer having an ethylenically unsaturated bond and at least one functional group selected from the group consisting of nitrile, amide, urethane, hydroxy and urea groups is still more preferred. With these monomers, the melting point of the polymer A tends to be high, and the heat-resistant storage stability tends to improve. Elasticity near room temperature is also higher, and durability tends to be improved.

The vinyl esters such as vinyl acetate, vinyl propionate, vinyl butyrate, vinyl caproate, vinyl caprylate, vinyl caprate, vinyl laurate, vinyl myristate, vinyl palmitate, vinyl stearate, vinyl pivalate and vinyl octylate can also be used by preference as the second polymerizable monomer. Vinyl esters are nonconjugated monomers, and have low reactivity with the first polymerizable monomer. It is thought that this makes it easier for the monomer units derived from the first polymerizable monomer to aggregate and form bonded states in the polymer A, thereby increasing the crystallinity of the polymer A and making it easier to achieve both low-temperature fixability and heat-resistant storage stability.

The second polymerizable monomer preferably has an ethylenically unsaturated bond, and more preferably has one ethylenically unsaturated bond.

Moreover, the second polymerizable monomer is preferably at least one selected from the group consisting of the following formulae (A) and (B).

(A)

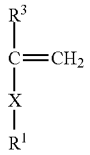

(B)

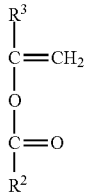

(In the formulae, X represents a single bond or a $C_{1-6}$ alkylene group, and $R^1$ represents a nitrile group (—C≡N), an amide group (—C(═O)NHR$^{10}$ ($R^{10}$ being a hydrogen atom or a $C_{1-4}$ alkyl group)), a hydroxy group, —COOR$^{11}$ ($R^{11}$ being a $C_{1-6}$ (preferably $C_{1-4}$) alkyl group or a $C_{1-6}$ (preferably $C_{1-4}$) hydroxyalkyl group), a urethane group (—NHCOOR$^{12}$ ($R^{12}$ being a $C_{1-4}$ alkyl group)), a urea group (—NH—C(═O)—N($R^{13}$)$_2$ (in which each $R^{13}$ is independently a hydrogen atom or a $C_{1-6}$ (preferably a $C_{1-4}$) alkyl group)), —COO($CH_2$)$_2$NHCOOR$^{14}$ ($R^{14}$ being a $C_{1-4}$ alkyl group) or —COO($CH_2$)$_2$—NH—C(═O)—N($R^{15}$)$_2$ (in which each $R^{15}$ is independently a hydrogen atom or a $C_{1-6}$ (preferably $C_{1-4}$) alkyl group).

Preferably $R^1$ is a nitrile group (—C≡N), an amide group (—C(═O)NHR$^{10}$ ($R^{10}$ being a hydrogen atom or a $C_{1-4}$ alkyl group)), a hydroxy group, —COOR$^{11}$ ($R^{11}$ being a $C_{1-6}$ (preferably $C_{1-4}$) alkyl group or a $C_{1-6}$ (preferably $C_{1-4}$) hydroxyalkyl group), a urea group (—NH—C(═O)—N($R^{13}$)$_2$ (in which each $R^{13}$ is independently a hydrogen atom or a $C_{1-6}$ (preferably $C_{1-4}$) alkyl group)), —COO($CH_2$)$_2$NHCOOR$^{14}$ ($R^{14}$ being a $C_{1-4}$ alkyl group) or —COO($CH_2$)$_2$—NH—C(═O)—N($R^{15}$)$_2$ (in which each $R^{15}$ is independently a hydrogen atom or a $C_{1-6}$ (preferably $C_{1-4}$) alkyl group).

$R^2$ is a $C_{1-4}$ alkyl group, and each $R^3$ is independently a hydrogen atom or a methyl group.)

The polymer A is preferably a vinyl polymer. The vinyl polymer may be a polymer of a monomer containing an ethylenically unsaturated bond for example. An ethylenically unsaturated bond is a radical polymerizable carbon-carbon double bond, and examples include vinyl, propenyl, acryloyl and methacryloyl groups and the like.

The polymer A may also contain a third monomer unit derived from a third polymerizable monomer outside the scope of the formulae (1) and (2) (that is, different from the first polymerizable monomer and second polymerizable monomer) as long as the molar ratios of the first monomer unit derived from the first polymerizable monomer and the second monomer unit derived from the second polymerizable monomer described above are preserved.

Of the monomers given as examples of the second polymerizable monomer, those that do not satisfy formula (1) or formula (2) above may be used as the third polymerizable monomer.

The following monomers may also be used for example: styrenes such as styrene and o-methylstyrene and their derivatives, and (meth)acrylic acid esters such as methyl (meth)acrylate, n-butyl (meth)acrylate, t-butyl (meth)acrylate and 2-ethylhexyl (meth)acrylate. When these monomers satisfy formula (1) or (2), they may be used as the second polymerizable monomer.

The third polymerizable monomer is preferably at least one selected from the group consisting of styrene, methyl methacrylate and methyl acrylate.

The toner particle contains a release agent with a molecular weight of at least 1,000. If the molecular weight is at least 1,000, compatibility with the polymer A is less, and phase separation occurs. The release properties are thus improved because the release agent is more likely to be exuded onto the surface of the toner particle during fixing.

If the molecular weight of the release agent is less than 1,000, the release agent is likely to be compatible with the polymer A in the toner particle, and less likely to be exuded during fixing, detracting from the release properties. Moreover, compatibility with the polymer A means that the crystallinity of the polymer A is reduced, and heat-resistant storage stability is likely to decline due to the lower melting point.

The molecular weight of the release agent is the peak molecular weight (Mp) in gel permeation chromatography (GPC). The measurement methods are described below.

The molecular weight of the release agent is preferably at least 1,500. There is no particular upper limit, but it is preferably not more than 10,000, or more preferably not more than 5,000 in order to ensure the release properties.

The release agent is not particularly limited as long as its molecular weight is at least 1,000, but examples include the following.

Aliphatic hydrocarbon waxes: low-molecular-weight polyethylene, low-molecular-weight polypropylene, low-molecular-weight olefin copolymers, Fischer-Tropsch wax, and oxides and acid-added waxes of these.

An ester wax consisting primarily of a fatty acid ester may also be used. From the standpoint of the molecular weight, the ester wax is preferably a trifunctional or higher ester wax, or more preferably a tetrafunctional or higher ester wax.

A trifunctional or higher ester wax is obtained for example by condensing a trifunctional or higher acid with a linear long-chain saturated alcohol, or by synthesizing a trifunctional or higher alcohol and a linear long-chain saturated fatty acid.

Examples of trifunctional or higher alcohols that can be used in the ester wax include, but are not limited to, those given below. A mixture of multiple ester waxes may also be used.

Examples include glycerin, trimethylol propane, erythritol, pentaerythritol and sorbitol. Examples of condensates of these include glycerin condensation products such as diglycerin, triglycerin, tetraglycerin, hexaglycerin and decaglycerin (so-called polyglycerins), trimethylolpropane condensation products such as ditrimethylolpropane and tristrimethylolpropane, and pentaerythritol condensation products such as dipentaerythritol and tris-pentaerythritol.

Of these, one having a branched structure is preferred, and pentaerythritol or dipentaerythritol is more preferred. Dipentaerythritol is especially preferred.

For the linear long-chain saturated fatty acid, one represented by the general formula $C_nH_{2n+1}COOH$ in which n is from 5 to 28 can be used by preference.

Examples include, but are not limited to, the following, and a mixture may also be used: caproic acid, caprylic acid, octylic acid, nonylic acid, decanoic acid, dodecanoic acid, lauric acid, tridecanoic acid, myristic acid, palmitic acid, stearic acid and behenic acid. Myristic acid, palmitic acid, stearic acid and behenic acid are preferred considering the melting point of the wax.

Examples of trifunctional or higher acids include, but are not limited to, trimellitic acid and butanetetracarboxylic acid, and a mixture may also be used in some cases.

For the linear long-chain saturated alcohol, one represented by the general formula $C_nH_{2n+1}OH$ in which n is from 5 to 28 can be used by preference.

Examples include, but are not limited to, the following, and a mixture may also be used: capryl alcohol, lauryl alcohol, myristyl alcohol, palmityl alcohol, stearyl alcohol and behenyl alcohol. Myristyl alcohol, palmityl alcohol, stearyl alcohol and behenyl alcohol are preferred considering the melting point of the wax.

The release agent preferably contains an aliphatic hydrocarbon wax, and more preferably is an aliphatic hydrocarbon wax. Because aliphatic hydrocarbon waxes have low polarity, they are more easily exuded from the polymer A during fixing.

The content of the release agent in the toner particle is preferably from 1.0 mass % to 30.0 mass %, or more preferably from 2.0 mass % to 25.0 mass %. If the content of the release agent in the toner particle is within this range, the release properties are easier to secure during fixing. If the content is at least 1.0 mass %, the toner release properties are good. If it is not more than 30.0 mass %, the release agent is unlikely to be exposed on the surface of the toner particle, and good heat-resistant storage stability is obtained.

The melting point of the release agent is preferably from 60° C. to 120° C. If the melting point of the release agent is within this range, it is more easily melted and exuded on the toner particle surface during fixing, and is more likely to provide release effects. The melting point is more preferably from 70° C. to 100° C. If the melting point is at least 60° C., the release agent is unlikely to be exposed on the surface of the toner particle, and good heat-resistant storage stability is obtained. If the melting point is not more than 120° C., the release agent melts properly during fixing, resulting in good low-temperature fixability and offset resistance.

Assuming that the SP value of the polymer A is taken as $SP_3$ $(J/cm^3)^{0.5}$ and the SP value of the release agent is taken as $SP_w$ $(J/cm^3)^{0.5}$, $SP_3$ and $SP_w$ preferably satisfy the following formula (3):

$$(SP_3-SP_w)\geq 1.00 \quad (3).$$

If $SP_3-SP_w$ is as shown in formula (3), the polymer A and release agent are likely to phase separate in the toner. The release agent also has a lower polarity than the polymer A. As a result, the release agent is likely to be effectively exuded on the toner particle surface during fixing, and the release properties tend to improve.

The methods for calculating $SP_3$ and $SP_w$ are explained below. $(SP_3-SP_w)$ is preferably at least 1.50. There is no particular upper limit, but preferably it is not more than 10.00, or more preferably not more than 5.00.

For purposes of maintaining toner crystallinity, the acid value of the polymer A is preferably not more than 30.0 mgKOH/g, or more preferably not more than 20.0 mgKOH/g.

If the acid value is not more than 30.0 mgKOH/g, crystallization of the polymer A is unlikely to be inhibited, and the melting point is easy to control. There is no particular lower limit to the acid value, which is preferably at least 0 mgKOH/g.

The weight-average molecular weight (Mw) of the tetrahydrofuran (THF)-soluble component of the polymer A as measured by GPC is preferably from 10,000 to 200,000, or more preferably from 20,000 to 150,000. If the Mw is within this range, it is easy to maintain elasticity near room temperature.

To achieve both low-temperature fixability and heat-resistant storage stability, the melting point of the polymer A is preferably from 50° C. to 80° C., or more preferably from 53° C. to 70° C. If the melting point of the polymer A is at least 50° C., good heat-resistant storage stability is obtained, while if it is not more than 80° C., good low-temperature fixability is obtained.

The melting point of the polymer A can be adjusted by adjusting the type and amount of the first polymerizable monomer and the type and amount of the second polymerizable monomer used.

The content of the polymer A in the binder resin is preferably at least 50.0 mass %. If it is at least 50.0 mass %, the toner can easily maintain a sharp-melt property, and low-temperature fixability is improved. More preferably the content is 80.0 mass % to 100 mass %, and most preferably the binder resin is the polymer A.

Examples of resins that can be used as binder resins other than the polymer A include vinyl resins, polyester resins, polyurethane resins and epoxy resins. Of these, vinyl resins, polyester resins and polyurethane resins are preferred from the standpoint of the electrophotographic properties.

Polymerizable monomers that can be used for the vinyl resin include the polymerizable monomers that can be used for the first polymerizable monomer, second polymerizable monomer and third polymerizable monomer as discussed above. A combination of two or more kinds may be used as necessary.

The polyester resin can be obtained by a reaction between a bivalent or higher polyvalent carboxylic acid and a polyhydric alcohol.

Examples of the polyvalent carboxylic acid include the following compounds: dibasic acids such as succinic acid, adipic acid, sebacic acid, phthalic acid, isophthalic acid, terephthalic acid, malonic acid and dodecenylsuccinic acid, and anhydrides and lower alkyl esters of these, aliphatic unsaturated dicarboxylic acids such as maleic acid, fumaric acid, itaconic acid and citraconic acid, and 1,2,4-benzenetricarboxylic acid and 1,2,5-benzenetricarboxylic, and anhydrides and lower alkyl esters of these. One of these alone or a combination of two or more may be used.

Examples of the polyhydric alcohol include the following compounds: alkylene glycols (ethylene glycol, 1,2-propylene glycol and 1,3-propylene glycol); alkylene ether glycols (polyethylene glycol and polypropylene glycol); alicyclic diols (1,4-cyclohexane dimethanol); bisphenols (bisphenol A); and alkylene oxide (ethylene oxide and propylene oxide) adducts of alicyclic diols. The alkyl parts of alkylene glycols and alkylene ether glycols may be either straight-chain or branched. Other examples include glycerin, trimethylol ethane, trimethylol propane, pentaerythritol and the like. One of these alone or a combination of two or more may be used.

A monovalent acid such as acetic acid or benzoic acid or a monohydric alcohol such as cyclohexanol or benzyl alcohol may also be used as necessary to adjust the acid value or hydroxy value.

The method for manufacturing the polyester resin is not particularly limited, and ester exchange methods or direct polycondensation methods may be used either alone or in combination.

The polyurethane resin is discussed next. The polyurethane resin is a reaction product of a diol and a substance containing a diisocyanate group, and resins having various functions can be obtained by adjusting the diol and diisocyanate.

Examples of the diisocyanate component include the following: aromatic diisocyanates that contains from 6 to 20 carbon atoms (here and below, excluding carbons atoms in NCO groups), aliphatic diisocyanates that contains from 2 to 18 carbon atoms, alicyclic diisocyanates that contains from 4 to 15 carbon atoms, and modified forms of these diisocyanates (modified forms containing urethane groups, carbodiimide groups, allophanate groups, urea groups, biuret groups, uretdione groups, urethimine groups, isocyanurato groups or oxazolidone groups (hereunder also called "modified isocyanates")), and mixtures of two or more of these.

Examples of aromatic diisocyanates include m- and/or p-xylylene diisocyanate (XDI) and α,α,α',α'-tetramethylxylylene diisocyanate.

Examples of aliphatic diisocyanates include ethylene diisocyanate, tetramethylene diisocyanate, hexamethylene diisocyanate (HDI) and dodecamethylene diisocyanate.

Examples of alicyclic diisocyanates include isophorone diisocyanate (IPDI), dicyclohexylmethane-4,4'-diisocyanate, cyclohexylene diisocyanate and methylcyclohexylene diisocyanate.

Of these, an aromatic diisocyanate that contains from 6 to 15 carbon atoms, an aliphatic diisocyanate that contains from 4 to 12 carbon atoms or an alicyclic diisocyanate that contains from 4 to 15 carbon atoms is preferred, and XDI, IPDI and HDI are especially preferred.

A trifunctional or higher isocyanate compound may also be used in addition to the diisocyanate component.

Diol components that can be used in the polyurethane resin include components similar to the bivalent alcohols that can be used in the polyester resin described above.

The toner may also contain a colorant. Examples of colorants include known organic pigments, organic dyes, inorganic pigments, and carbon black and magnetic particles as black colorants. Other colorants conventionally used in toners may also be used.

Examples of yellow colorants include condensed azo compounds, isoindolinone compounds, anthraquinone compounds, azo metal complexes, methine compounds and allylamide compounds. Specifically, C.I. pigment yellow 12, 13, 14, 15, 17, 62, 74, 83, 93, 94, 95, 109, 110, 111, 128, 129, 147, 155, 168 and 180 can be used by preference.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specifically, C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254 can be used by preference.

Examples of cyan colorants include copper phthalocyanine compounds and their derivatives, anthraquinone compounds, and basic dye lake compounds. Specifically, C.I. pigment blue 1, 7, 15, 15:1, 15:2, 15:3, 15:4, 60, 62 and 66 can be used by preference.

The colorants are selected based on considerations of hue angle, chroma, lightness, weather resistance, OHP transparency, and dispersibility in the toner.

The content of the colorant is preferably from 1.0 to 20.0 mass parts per 100.0 mass parts of the binder resin. When a magnetic particle is used as the colorant, the content thereof is preferably from 40.0 to 150.0 mass parts per 100.0 mass parts of the binder resin.

A charge control agent may be included in the toner as necessary. A charge control agent may also be added externally to the toner. By compound a charge control agent, it is possible to stabilize the charging properties and control the triboelectric charge quantity at a level appropriate to the developing system.

A known charge control agent may be used, and a charge control agent capable of providing a rapid charging speed and stably maintaining a uniform charge quantity is especially desirable.

Organic metal compounds and chelate compounds are effective as charge control agents for giving the toner a negative charge, and examples include monoazo metal compounds, acetylacetone metal compounds, and metal compounds using aromatic oxycarboxylic acids, aromatic dicarboxylic acids, oxycarboxylic acids and dicarboxylic acids.

Examples of charge control agents for giving the toner a positive charge include nigrosin, quaternary ammonium salts, metal salts of higher fatty acids, diorganotin borates, guanidine compounds and imidazole compounds.

The content of the charge control agent is preferably from 0.01 to 20.0 mass parts, or more preferably from 0.5 to 10.0 mass parts per 100.0 mass parts of the toner particle.

The toner particle may be used as is as the toner, or external additives such as inorganic particles may be added to the toner particle to obtain a toner.

An inorganic fine particle is preferably added to the toner particle. Examples of inorganic fine particles for adding to the toner particle include silica fine particles, titanium oxide fine particles, alumina fine particles and complex oxide particles of these. Of the inorganic fine particles, silica fine particles and titanium oxide fine particles are desirable for improving flowability and charge uniformity.

Examples of silica fine particles include fumed silica or dry silica produced by vapor phase oxidation of silicon halides, and wet silica produced from water glass. Of these, a dry silica containing little $Na_2O$ or $SO_3^{2-}$ or with few silanol groups on the surface or inside the silica fine particle is preferred. Furthermore, a dry silica may also be a composite fine particle of silica with another metal oxide, manufactured using a metal halide compound such as aluminum chloride or titanium chloride together with a silicon halide compound in the manufacturing process.

It is more desirable to use a hydrophobically treated silica fine particle because it is possible to adjust the charge quantity of the toner and improve the environmental stability and toner properties in high-humidity environments by hydrophobically treating the silica fine particle. Hydrophobic treatment prevents the silica fine particle from absorbing moisture, allowing the charge quantity to be maintained and resulting in good developing performance and transferability.

The treatment agent for hydrophobic treatment of the silica fine particle may be a silicone oil, silane compound, silane coupling agent or other organic silicon compound or an organic titanium compound. These treatment agents may be used alone or combined.

Of these, a silica fine particle treated with a silicone oil is preferred.

Although winding around the fixing member can be prevented in the toner of the invention because the release agent is exuded onto the toner particle surface during fixing, slight irregularities may occur on the surface of the fixed image due to re-crystallization of the polymer A after fixing because the polymer A in the toner is highly crystalline. Gloss may decline as a result. To maintain high gloss, therefore, it is desirable to make the toner particle surface difficult to re-crystallize.

Because silicone oil is compatible with the polymer A and tends to inhibit re-crystallization, re-crystallization of the toner is inhibited and slight irregularities are less likely to form on the surface of the fixed image if a silicone oil-treated silica fine particle is present on the toner particle surface. This serves to prevent a loss of gloss.

A known silicone oil may be used as the silicone oil for treating the silica fine particle, without any particular limitations, but straight silicone is especially desirable.

Specific examples include dimethyl silicone oil, alkyl modified silicone oil, alpha-methylstyrene modified silicone oil, fluorine modified silicone oil and methyl hydrogen silicone oil. The viscosity of the silicone oil used in treatment is preferably from 30 $mm^2/s$ to 1200 $mm^2/s$, or more preferably from 70 $mm^2/s$ to 800 $mm^2/s$.

The method of silicone oil treatment may be for example a method of directly mixing the silica fine particle and silicone oil in a mixer such as Henschel mixer, or a method of stirring the silica fine particle while spraying it with the silicone oil. The silicone oil may also be dissolved or dispersed in a suitable solvent (preferably adjusted to pH 4 with an organic acid or the like) and then mixed with the silica fine particle, after which the solvent is removed. Another method is to place the silica fine particle in a reaction tank, add alcohol water while stirring in a nitrogen atmosphere, then introduce a silicone oil treatment solution into the reaction tank to perform surface treatment, and finally heating and stirring to remove the solvent.

The number-average particle diameter of a primary particle of the silica fine particle is preferably from 5 nm to 20 nm. Within this range, the flowability of the toner tends to be improved.

The content of the inorganic fine particle is preferably from 0.1 to 4.0 parts by mass, or more preferably from 0.2 to 3.5 parts by mass per 100.0 mass parts of the toner particle.

It is also desirable to add a silica particle with a number-average diameter of from 30 nm to 500 nm, or more preferably from 50 nm to 300 nm of the primary particle to the toner particle. When this silica particle is added, it functions adequately as a spacer particle and can control toner deterioration in the developing nip and regulating member nip.

The silica particle can be manufactured in the same way as the silica fine particle above, but is preferably manufactured by a sol-gel method. In a sol-gel method, an alkoxysilane is hydrolyzed with a catalyst in an organic solvent containing water, and condensed to obtain a silica sol suspension, after which the solvent is removed and the product is dried and made into particles. A silica particle obtained by this sol-gel method has a suitable particle diameter and particle size distribution, and because it is also monodispersed and spherical, it can be easily dispersed uniformly on the toner particle surface, and can also exert a stable spacer effect to reduce the physical adhesive force of the toner.

Like the silica fine particle, the silica particle is also preferably hydrophobically treated.

The content of a silica particle with a number-average diameter of from 30 nm to 500 nm of the primary particle is preferably from 0.1 to 2.0 mass parts per 100 mass parts of the toner particle.

Within the scope of the present configuration, the toner particle may be manufactured by any known conventional method such as suspension polymerization, emulsion polymerization, dissolution suspension or pulverization, but is preferably manufactured by a suspension polymerization method.

For example, the polymerizable monomers for producing a binder resin containing the polymer A and release agent can be mixed together with other additives such as colorants as necessary to obtain a polymerizable monomer composition. This polymerizable monomer composition is then added to a continuous phase (such as an aqueous solvent, in which a dispersion stabilizer may be included as necessary). Particles of the polymerizable monomer composition are then formed in the continuous phase (aqueous solvent), and the polymerizable monomers contained in those particles are polymerized. A toner particle can be obtained in this way.

Methods for calculating and measuring the various physical properties of the toner and toner materials are given below.

Method for Measuring Percentage Contents of Monomer Units Derived from Each Polymerizable Monomer in Polymer A The contents of the monomer units derived from each polymerizable monomer in the polymer A are measured by $^1$H-NMR under the following conditions.

Measurement unit: FT NMR unit JNM-EX400 (JEOL Ltd.)

Measurement frequency: 400 MHz

Pulse condition: 5.0

Frequency range: 10,500 Hz

Number of integrations: 64

Measurement temperature: 30° C.

Sample: Prepared by placing 50 mg of the measurement sample in a sample tube with an inner diameter of 5 mm, adding deuterated chloroform ($CDCl_3$) as a solvent, and dissolving this in a thermostatic tank at 40° C.

Of the peaks attributable to constituent elements of monomer units derived from the first polymerizable monomer in the resulting $^1$H-NMR chart, a peak independent of peaks attributable to constituent elements of otherwise-derived monomer units is selected, and the integrated value $S_1$ of this peak is calculated.

Similarly, a peak independent of peaks attributable to constituent elements of otherwise-derived monomer units is selected from the peaks attributable to constituent elements of monomer units derived from the second polymerizable monomer, and the integrated value $S_2$ of this peak is calculated.

When a third polymerizable monomer is used, moreover, a peak independent of peaks attributable to constituent elements of otherwise-derived monomer units is selected from the peaks attributable to constituent elements of monomer units derived from the third polymerizable monomer, and the integrated value $S_3$ of this peak is calculated.

The content of the monomer unit derived from the first polymerizable monomer is determined as follows using the integrated values $S_1$, $S_2$ and $S_3$. $n_1$, $n_2$ and $n_3$ are the numbers of hydrogen atoms in the constituent elements to which the observed peaks are attributed for each segment.

$$\text{Ratio (mol \%) of monomer units derived from first polymerizable monomer}=\{(S_1/n_1)/((S_1/n_1)+(S_2/n_2)+(S_3/n_3)\}\times 100$$

The ratios of monomer units derived from the second and third polymerizable monomers are determined similarly as follows.

$$\text{Ratio (mol \%) of monomer units derived from second polymerizable monomer}=\{(S_2/n_2)/((S_1/n_1)+(S_2/n_2)+(S_3/n_3)\}\times 100$$

$$\text{Ratio (mol \%) of monomer units derived from third polymerizable monomer}=\{(S_3/n_3)/((S_1/n_1)+(S_2/n_2)+(S_3/n_3)\}\times 100$$

When a polymerizable monomer containing no hydrogen atoms is used for a constituent element other than a vinyl group in the polymer A, measurement is performed in single pulse mode by $^{13}$C-NMR using $^{13}$C as the measured nucleus, and the ratio is calculated in the same way as by $^{1}$H-NMR.

When the toner is manufactured by suspension polymerization, independent peaks may not be observed because the peaks of the release agent and other resins overlap. Therefore, in some cases it may not be possible to calculate the contents of the monomer units derived from the polymerizable monomers in the polymer A. In such cases, a polymer A' can be manufactured and analyzed as the polymer A by performing similar suspension polymerization without using a release agent or other resin.

Method for Calculating SP Value $SP_{12}$, $SP_{22}$ and $SP_w$ are determined as follows following the calculation methods proposed by Fedors.

The evaporation energy (Δei) (cal/mol) and molar volume (Δvi) (cm$^3$/mol) are determined from the tables described in "Polym. Eng. Sci., 14(2), 147-154 (1974)" for the atoms or atomic groups in the molecular structures of each of the polymerizable monomers and the release agent, and $(4.184\times\Sigma\Delta ei/\Sigma\Delta vi)^{0.5}$ is given as the SP value $(J/cm^3)^{0.5}$.

$SP_{11}$ and $SP_{21}$ are calculated by similar methods for the atoms or atomic groups in the molecular structures of the same polymerizable monomers with the double bonds cleaved by polymerization.

$SP_3$ is calculated from the following formula (4) by determining the evaporation energy (Δei) and molar volume (Δvi) of each monomer unit derived from each polymerizable monomer constituting the polymer A, multiplying these by the molar ratio (j) of each monomer unit in the polymer A, and then dividing the sum of the evaporation energies of each monomer unit by the sum of the molar volumes.

$$SP_3=\{4.184\times(\Sigma j\times\Sigma\Delta ei)/(\Sigma j\times\Sigma\Delta vi)\}^{0.5} \quad (4)$$

Method for Measuring Molecular Weight of Release Agent

The molecular weight (Mp) of the release agent is measured as follows by gel permeation chromatography (GPC). Special-grade 2,6-di-t-butyl-4-methylphenol (BHT) is added to a concentration of 0.10 mass/vol % to o-dichlorobenzene for gel chromatography, and dissolved at room temperature.

The release agent and the o-dichlorobenzene with the added BHT are placed in a sample bin, and heated on a hot plate set to 150° C. to dissolve the release agent. Once the release agent has dissolved it is placed in a pre-heated filter unit, and set in the main unit. The sample passing through the filter unit is taken as the GPC sample. The sample solution is adjusted to a concentration of 0.15 mass %. Measurement is performed under the following conditions using this sample solution.

Device: HLC-8121 GPC/HT (Tosoh)
Detector: High-temperature RI
Columns: TSKgel GMHHR-H HT (2) (Tosoh)
Temperature: 135.0° C.
Solvent: o-dichlorobenzene for gel chromatography (with 0.10 mass/vol % added BHT)
Flow rate: 1.0 mL/min
Injection volume: 0.4 mL A molecular weight calibration curve prepared using standard polystyrene resin (for example, TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weight of the release agent.

Method for Measuring Mw of Polymer A

The molecular weight (Mw) of the THF-soluble component of the polymer A is measured as follows by gel permeation chromatography (GPC).

First, the sample is dissolved in tetrahydrofuran (THF) at room temperature over the course of 24 hours. The resulting solution is filtered through a solvent-resistant membrane filter (Maishori Disk, Tosoh Corp.) having a pore diameter of 0.2 μm to obtain a sample solution. The concentration of THF-soluble components in the sample solution is adjusted to about 0.8 mass %. Measurement is performed under the following conditions using this sample solution.

Device: HLC8120 GPC (detector: RI) (Tosoh Corp.)
Columns: Shodex KF-801, 802, 803, 804, 805, 806, 807 (total 7) (Showa Denko)
Eluent: Tetrahydrofuran (THF)
Flow rate: 1.0 mL/min
Oven temperature: 40.0° C.
Sample injection volume: 0.10 mL A molecular weight calibration curve prepared using standard polystyrene resin (such as TSK standard polystyrene F-850, F-450, F-288, F-128, F-80, F-40, F-20, F-10, F-4, F-2, F-1, A-5000, A-2500, A-1000, A-500, Tosoh Corp.) is used for calculating the molecular weights of the samples.

Method for Measuring Melting Point

The melting points of the polymer A and release agent are measured under the following conditions using a DSC Q1000 (TA Instruments).

Ramp rate: 10° C./min
Measurement start temperature: 20° C.
Measurement end temperature: 180° C.

The melting points of indium and zinc are used for temperature correction of the device detection part, and the heat of fusion of indium is used for correction of the calorific value.

Specifically, 5 mg of sample is weighed precisely, placed in an aluminum pan, and subjected to differential canning calorimetry. An empty silver pan is used for reference.

The peak temperature of the maximum endothermic peak during the first temperature rise is given as the melting point.

When multiple peaks are present, the maximum endothermic peak is the peak at which the endothermic quantity is the greatest.

Method for Measuring Acid Value

The acid value is the number of mg of potassium hydroxide needed to neutralize the acid contained in 1 g of sample. The acid value of the polymer A in the present invention is measured in accordance with JIS K 0070-1992, and the specific measurement procedures are as follows.

(1) Reagent Preparation

A phenolphthalein solution is obtained by dissolving 1.0 g of phenolphthalein in 90 mL of ethyl alcohol (95 vol %) and adding ion-exchanged water to a total of 100 mL.

7 g of special-grade potassium hydroxide is dissolved in 5 mL of water, and this is brought to 1 L by addition of ethyl alcohol (95 vol %). This is placed in an alkali-resistant container while avoiding contact with carbon dioxide and the like, allowed to stand for 3 days, and filtered to obtain a potassium hydroxide solution. The resulting potassium hydroxide solution is stored in an alkali-resistant container. The factor of this potassium hydroxide solution is determined from the amount of the potassium hydroxide solution required for neutralization when 25 mL of 0.1 mol/L hydrochloric acid is introduced into an Erlenmeyer flask, several drops of the phenolphthalein solution are added, and titration is performed with the potassium hydroxide solution. The 0.1 mol/L hydrochloric acid is prepared in accordance with JIS K 8001-1998.

(2) Operations (A) Main Test 2.0 g of a pulverized sample of the polymer A is weighed exactly into a 200 mL Erlenmeyer flask, 100 mL of a toluene:ethanol (2:1) mixed solution is added, and the sample is dissolved over the course of 5 hours. Several drops of the phenolphthalein solution are then added as an indicator, and titration is performed using the potassium hydroxide solution. The titration endpoint is taken to be persistence of the faint pink color of the indicator for 30 seconds.

(B) Blank Test

Titration is performed by the same procedures, but without using any sample (that is, with only the toluene:ethanol (2:1) mixed solution).

(3) The acid value is calculated by substituting the obtained results into the following formula.

$$A=[(C-B)\times f\times 5.61]/S$$

Here, A: acid value (mgKOH/g), B: added amount (mL) of potassium hydroxide solution in blank test, C: added amount (mL) of potassium hydroxide solution in main test, f: factor for potassium hydroxide solution, S: mass of sample (g).

Method for Measuring Number-Average Particle Diameters of Primary Particles of Silica Fine Particle and Silica Particle The particle diameters of primary particles of the silica fine particle and silica particle were observed with an 54700 scanning electron microscope (Hitachi, Ltd.), the long diameters of 100 particles were measured, and the average value was given as the number-average diameter of the primary particle.

EXAMPLES

The present invention is explained in detail below using examples, but the invention is not limited by these examples. Unless otherwise specified, parts in the formulations below are based on mass.

Preparation of Monomer Having Urethane Group 50.0 parts of methanol were loaded into a reactor, after which 5.0 parts of KarenzMOI (2-isocyanatoethyl methacrylate, Showa Denko) were added dropwise at 40° C. under stirring. After completion of dropping, this was stirred for 2 hours with the temperature maintained at 40° C. The unreacted methanol was then removed in an evaporator to prepare a monomer having a urethane group.

Preparation of Monomer Having Urea Group 50.0 parts of dibutylamine were loaded into a reactor, after which 5.0 parts of KarenzMOI (2-isocyanatoethyl methacrylate, Showa Denko) were added dropwise at room temperature under stirring. After completion of dropping, this was stirred for 2 hours. The unreacted dibutylamine was then removed in an evaporator to prepare a monomer having a urea group.

Preparation of Polymer A0

The following materials were loaded in a nitrogen atmosphere into a reactor equipped with a reflux condenser, a stirrer, a thermometer and a nitrogen introduction pipe.

Toluene 100.0 parts

Monomer composition 100.0 parts (The monomer composition is a mixture of the following behenyl acrylate, methacrylonitrile and styrene in the following proportions.)

- Behenyl acrylate (first polymerizable monomer) 67.0 parts (28.9 mol %)
- Methacrylonitrile (second polymerizable monomer) 22.0 parts (53.8 mol %)
- Styrene (third polymerizable monomer) 11.0 parts (17.3 mol %)
- Polymerization initiator: t-butyl peroxypivalate (Perbutyl PV, NOF Corp.) 0.5 parts The reactor contents were stirred at 200 rpm, heated to 70° C., and polymerized for 12 hours to obtain a solution of the polymers of the monomer composition dissolved in toluene. Next, this solution was cooled to 25° C., and added with stirring to 1,000.0 parts of methanol to precipitate a methanol-insoluble component. The resulting methanol-insoluble component was filtered out, further washed with methanol, and vacuum dried for 24 hours at 40° C. to obtain a polymer A0. The polymer A0 had a weight-average molecular weight (Mw) of 68,400, an acid value of 0.0 mgKOH/g, and a melting point of 62° C.

NMR analysis of this polymer A0 showed that it contained 28.9 mol % monomer units derived from behenyl acrylate, 53.8 mol % monomer units derived from methacrylonitrile and 17.3% monomer units derived from styrene.

Preparation of Amorphous Resin

Nitrogen was introduced into a heat-dried two-necked flask as the following raw materials were added.

| | |
|---|---|
| Polyoxypropylene (2.2)-2,2-bis(4-hydroxyphenyl) propane | 30.0 parts |
| Polyoxyethylene (2.2)-2,2-bis(4-hydroxyphenyl) propane | 33.0 parts |
| Terephthalic acid | 21.0 parts |
| Dodecenylsuccinic acid | 15.0 parts |
| Dibutyl tin oxide | 0.1 part |

The system was purged with nitrogen by a depressurization operation, and stirred for 5 hours at 215° C. Stirring was then continued as the temperature was gradually raised to 230° C. under reduced pressure, and maintained for a further 2 hours. Once a viscous state was reached, this was air cooled to stop the reaction and synthesize an amorphous polyester as an amorphous resin. The amorphous resin had an Mn of 5,200, a Mw of 23,000 and a Tg of 55° C.

Preparation of Silica Fine Particle 10.0 parts of polydimethylsiloxane (viscosity=100 $mm^2/s$) were sprayed onto 100 parts of fumed silica (brand name AEROSIL 380S, BET specific surface area 380 $m^2/g$, number-average diameter of primary particle 7 nm, Nippon Aerosil Co.), and stirring was continued for 30 minutes. The silica was then heated to 300° C. under stirring, and stirred for a further 2 hours to prepare a silica fine particle 1.

A silica fine particle that had not been treated with polydimethylsiloxane was used as a silica fine particle 2.

Preparation of Silica Particle 542.7 parts of methanol, 42.0 parts of pure water and 47.1 parts of 28 mass % ammonia water were placed in a 3 L glass reactor equipped with a stirrer, a dripping funnel and a thermometer, and mixed. The resulting solution was adjusted to 35° C., and stirred as addition of 1100.0 parts of tetramethoxysilane and 395.2 parts of 5.4 mass % ammonia water was initiated. Both were added dropwise, the tetramethoxysilane over the course of 7 hours and the ammonia water over the course of 6 hours.

After completion of dropping, stirring was continued for a further 0.2 hours to perform hydrolysis and obtain a methanol water dispersion of a spherical sol-gel silica fine particle. This dispersion was then thoroughly dried at 80° C. under reduced pressure to obtain a pre-treatment silica particle. The number-average diameter of a primary particle of the pre-treatment silica particle was 120 nm.

Next, 100.0 parts of the pre-treatment silica particle were placed in a reactor, and sprayed under stirring in a nitrogen atmosphere with a solution of 5.0 parts of polydimethylsiloxane (viscosity=100 $mm^2/s$) diluted with 5.0 parts of normal hexane. This mixture was then stirred and dried for 60 minutes at 300° C. in a nitrogen flow, and cooled to obtain a silica particle. The number-average diameter of a primary particle of the silica particle was 120 nm.

Example 1

| Manufacture of Toner by Suspension Polymerization<br>Manufacture of Toner Particle 1 | |
|---|---|
| Monomer composition<br>(The monomer composition is a mixture of the following behenyl acrylate, methacrylonitrile and styrene in the following proportions.) | 100.0 parts |
| Behenyl acrylate<br>(first polymerizable monomer) | 67.0 parts (28.9 mol %) |
| Methacrylonitrile<br>(second polymerizable monomer) | 22.0 parts (53.8 mol %) |
| Styrene (third polymerizable monomer) | 11.0 parts (17.3 mol %) |
| Pigment blue 15:3 | 6.5 parts |
| Aluminum di-t-butylsalicylate | 1.0 parts |
| Release agent 1<br>(Release agent 1: Excerex 30050B, molecular weight (Mp) 2,700, melting point 91° C., Mitsui Chemicals, Inc.) | 10.0 parts |
| Toluene | 100.0 parts |

A mixture consisting of the above materials was prepared, loaded into an attritor (Nippon Coke & Engineering), and dispersed for 2 hours at 200 rpm with zirconia beads 5 mm in diameter to obtain a raw material dispersion.

Meanwhile, 735.0 parts of ion-exchanged water and 16.0 parts of trisodium phosphate (12-hydrate) were added to a vessel provided with a Homomixer high-speed agitator (Primix) and a thermometer, and stirred at 12,000 rpm as the temperature was raised to 60° C. A calcium carbonate aqueous solution of 9.0 parts of calcium carbonate (2-hydrate) dissolved in 65.0 parts of ion-exchanged water was added, and stirred for 30 minutes at 12,000 rpm with the temperature maintained at 60° C. 10% hydrochloric acid was added to adjust the pH to 6.0 and obtain a water-based medium containing a dispersion stabilizer.

Next, the above raw material dispersion was transferred to a vessel equipped with a stirring device and a thermometer, and stirred at 100 rpm as the temperature was raised to 60° C. 8.0 parts of t-butyl peroxypivalate (NOF: Perbutyl PV) were then added as a polymerization initiator, and stirred for 5 minutes at 100 rpm with the temperature maintained at 60° C., after which the mixture was added to the water-based medium as the medium under stirring at 12,000 rpm with the high-speed stirring device. The temperature was then maintained at 60° C. as stirring was continued for 20 minutes at 12,000 rpm with the high-speed stirring device to obtain a granulating liquid.

This granulating liquid was transferred to a reactor equipped with a reflux condenser, a stirrer, a thermometer and a nitrogen introduction tube, and stirred at 150 rpm in a nitrogen atmosphere as the temperature was raised to 70° C. A polymerization reaction was then performed for 10 hours at 150 rpm with the temperature maintained at 70° C. The reflux condenser was then removed from the reactor, the temperature of the reaction solution was raised to 95° C., and the solution was stirred for 5 hours at 150 rpm with the temperature maintained at 95° C. to remove the toluene and obtain a toner particle dispersion.

The resulting toner particle dispersion was cooled to 20° C. while being stirred at 150 rpm, after which stirring was maintained as dilute hydrochloric acid was added to bring the pH to 1.5 and dissolve the dispersion stabilizer. The solids were filtered out, and after thorough washing with ion-exchanged water, this was vacuum dried for 24 hours at 40° C. to obtain a toner particle 1 containing the polymer A1 of the monomer composition.

Furthermore, a polymer A1' was also obtained as in the manufacturing method of the toner particle 1 except that no pigment blue 15:3, aluminum di-t-butyl salicylate or release agent 1 were used. The polymer A1' had a weight-average molecular weight (Mw) of 56,000, an acid value of 0.0 mgKOH/g, and a melting point of 62° C. When the polymer A1 was analyzed by NMR, it was found to contain 28.9 mol % of monomer units derived from behenyl acrylate, 53.8 mol % of monomer units derived from methacrylonitrile and 17.3 mol % of monomer units derived from styrene. Because the polymer A1 and polymer A1' were prepared in the same way, they are judged to have similar physical properties.

Preparation of Toner 1

External additions were made to the toner particle 1. 1.8 parts of the silica fine particle 1 and 0.3 parts of the silica particle were dry mixed for 5 minutes with 100.0 parts of the toner particle 1 in a Henschel mixer (Mitsui Mining) to obtain a toner 1. The physical properties of the resulting toner 1 are shown in Tables 2-1 and 2-2, and the evaluation results are shown in Table 7.

TABLE 1

| Example | First polymerizable monomer | | Second polymerizable monomer | | Third polymerizable monomer | | Release agent | |
|---|---|---|---|---|---|---|---|---|
| No. | Type | Parts | Type | Parts | Type | Parts | No. | Parts |
| 1 | Behenyl acrylate | 67.0 | Methacrylonitrile | 22.0 | Styrene | 11.0 | 1 | 10.0 |
| 2 | Behenyl acrylate | 40.0 | Methacrylonitrile | 40.0 | Styrene | 20.0 | 1 | 10.0 |

TABLE 1-continued

| Example | First polymerizable monomer | | Second polymerizable monomer | | Third polymerizable monomer | | Release agent | |
|---|---|---|---|---|---|---|---|---|
| No. | Type | Parts | Type | Parts | Type | Parts | No. | Parts |
| 3 | Behenyl acrylate | 89.0 | Methacrylonitrile | 11.0 | — | — | 1 | 10.0 |
| 4 | Behenyl acrylate | 61.0 | Methacrylonitrile | 9.0 | Styrene | 30.0 | 1 | 10.0 |
| 5 | Behenyl acrylate | 40.0 | Methacrylonitrile | 60.0 | — | — | 1 | 10.0 |
| 6 | Behenyl acrylate | 34.0 | Methacrylonitrile | 11.0 | Styrene | 55.0 | 1 | 10.0 |
| 7 | Behenyl acrylate | 67.0 | Acrylonitrile | 22.0 | Styrene | 11.0 | 1 | 10.0 |
| 8 | Behenyl acrylate | 50.0 | 2-hydroxypropyl methacrylate | 40.0 | Styrene | 10.0 | 1 | 10.0 |
| 9 | Behenyl acrylate | 60.0 | Vinyl acetate | 30.0 | Styrene | 10.0 | 1 | 10.0 |
| 10 | Behenyl acrylate | 60.0 | Methyl acrylate | 30.0 | Styrene | 10.0 | 1 | 10.0 |
| 11 | Behenyl acrylate | 65.0 | Acrylamide | 25.0 | Styrene | 10.0 | 1 | 10.0 |
| 12 | Behenyl acrylate | 61.0 | Acrylic acid | 9.0 | Methyl methacrylate | 30.0 | 1 | 10.0 |
| 13 | Stearyl acrylate | 67.0 | Methacrylonitrile | 22.0 | Styrene | 11.0 | 1 | 10.0 |
| 14 | Myricyl acrylate | 67.0 | Methacrylonitrile | 22.0 | Styrene | 11.0 | 1 | 10.0 |
| 15 | Octacosyl acrylate | 67.0 | Methacrylonitrile | 22.0 | Styrene | 11.0 | 1 | 10.0 |
| 16 | Behenyl acrylate | 63.0 | Methacrylonitrile | 7.0 | Styrene | 23.0 | 1 | 10.0 |
| | | | Acrylic acid | 7.0 | | | | |
| 17 | Behenyl acrylate | 63.0 | Methacrylonitrile | 15.0 | Styrene | 15.0 | 1 | 10.0 |
| | | | Acrylic acid | 7.0 | | | | |
| 18 | Behenyl acrylate | 47.0 | Methacrylonitrile | 22.0 | Styrene | 11.0 | 1 | 10.0 |
| | Stearyl acrylate | 20.0 | | | | | | |
| 19 | Behenyl acrylate | 40.0 | Acrylonitrile | 27.5 | Styrene | 30.0 | 1 | 10.0 |
| | | | Monomer having urethane group | 2.5 | | | | |
| 20 | Behenyl acrylate | 40.0 | Acrylonitrile | 27.5 | Styrene | 30.0 | 1 | 10.0 |
| | | | Monomer having urea group | 2.5 | | | | |
| 21 | Behenyl acrylate | 67.0 | Methacrylonitrile | 22.0 | Styrene | 11.0 | 2 | 10.0 |
| 22 | Behenyl acrylate | 67.0 | Methacrylonitrile | 22.0 | Styrene | 11.0 | 3 | 10.0 |
| 23 | Behenyl acrylate | 67.0 | Methacrylonitrile | 22.0 | Styrene | 11.0 | 4 | 10.0 |
| 24 | Behenyl acrylate | 67.0 | Methacrylonitrile | 22.0 | Styrene | 11.0 | 5 | 10.0 |
| 25 | Behenyl acrylate | 67.0 | Methacrylonitrile | 22.0 | Styrene | 11.0 | 6 | 10.0 |
| 26 | Behenyl acrylate | 89.0 | Methacrylonitrile | 11.0 | — | — | 6 | 10.0 |
| 27 | Behenyl acrylate | 67.0 | Methacrylonitrile | 22.0 | Styrene | 11.0 | 1 | 10.0 |
| 28 | Behenyl acrylate | 67.0 | Methacrylonitrile | 22.0 | Styrene | 11.0 | 1 | 10.0 |
| 35 | Behenyl acrylate | 33.0 | Methacrylonitrile | 22.0 | Styrene | 11.0 | 1 | 10.0 |
| | Behenyl methacrylate | 34.0 | | | | | | |
| 36 | Behenyl acrylate | 25.0 | Vinyl acetate | 75.0 | — | — | 1 | 10.0 |
| C. E. 1 | Behenyl acrylate | 66.6 | Acrylic acid | 4.8 | Methyl methacrylate | 28.6 | 7 | 10.0 |
| C. E. 2 | Behenyl acrylate | 90.0 | Methacrylonitrile | 10.0 | — | — | 1 | 10.0 |
| C. E. 3 | Behenyl acrylate | 61.0 | Methacrylonitrile | 7.0 | Styrene | 32.0 | 1 | 10.0 |
| C. E. 4 | Hexadecyl acrylate | 61.0 | Methacrylonitrile | 26.0 | Styrene | 13.0 | 1 | 10.0 |
| C. E. 5 | Behenyl acrylate | 60.0 | — | — | Styrene | 11.0 | 1 | 10.0 |
| | | | | | Methyl methacrylate | 29.0 | | |
| C. E. 6 | Behenyl acrylate | 67.0 | Methacrylonitrile | 29.0 | Styrene | 11.0 | 8 | 10.0 |

In the Table, C.E. denotes "comparative example".

TABLE 2-1

| Example | Toner | Manufacturing | Polymer A | | | | | |
|---|---|---|---|---|---|---|---|---|
| | | | First polymerizable monomer | | Second polymerizable monomer | | Third polymerizable monomer | |
| No. | No. | method | Type | mol % | Type | mol % | Type | mol % |
| 1 | 1 | SP | Behenyl acrylate | 28.9 | Methacrylonitrile | 53.8 | Styrene | 17.3 |
| 2 | 2 | SP | Behenyl acrylate | 11.8 | Methacrylonitrile | 66.7 | Styrene | 21.5 |
| 3 | 3 | SP | Behenyl acrylate | 58.8 | Methacrylonitrile | 41.2 | — | — |
| 4 | 4 | SP | Behenyl acrylate | 27.5 | Methacrylonitrile | 23.0 | Styrene | 49.5 |
| 5 | 5 | SP | Behenyl acrylate | 10.5 | Methacrylonitrile | 89.5 | — | — |
| 6 | 6 | SP | Behenyl acrylate | 11.4 | Methacrylonitrile | 21.0 | Styrene | 67.6 |
| 7 | 7 | SP | Behenyl acrylate | 25.3 | Acrylonitrile | 59.5 | Styrene | 15.2 |
| 8 | 8 | SP | Behenyl acrylate | 26.0 | 2-hydroxypropyl methacrylate | 55.0 | Styrene | 19.0 |
| 9 | 9 | SP | Behenyl acrylate | 26.2 | Vinyl acetate | 57.9 | Styrene | 15.9 |
| 10 | 10 | SP | Behenyl acrylate | 26.2 | Methyl acrylate | 57.9 | Styrene | 15.9 |
| 11 | 11 | SP | Behenyl acrylate | 27.6 | Acrylamide | 56.9 | Styrene | 15.5 |
| 12 | 12 | SP | Behenyl acrylate | 27.4 | Acrylic acid | 21.4 | Methyl methacrylate | 51.2 |
| 13 | 13 | SP | Stearyl acrylate | 32.3 | Methacrylonitrile | 51.2 | Styrene | 16.5 |
| 14 | 14 | SP | Myricyl acrylate | 23.9 | Methacrylonitrile | 57.6 | Styrene | 18.5 |
| 15 | 15 | SP | Octacosyl acrylate | 25.0 | Methacrylonitrile | 56.8 | Styrene | 18.2 |
| 16 | 16 | SP | Behenyl acrylate | 28.2 | Methacrylonitrile | 17.7 | Styrene | 37.6 |
| | | | | | Acrylic acid | 16.5 | | |
| 17 | 17 | SP | Behenyl acrylate | 26.3 | Methacrylonitrile | 35.5 | Styrene | 22.8 |
| | | | | | Acrylic acid | 15.4 | | |

TABLE 2-1-continued

| Example No. | Toner No. | Manufacturing method | Polymer A: First polymerizable monomer Type | mol % | Second polymerizable monomer Type | mol % | Third polymerizable monomer Type | mol % |
|---|---|---|---|---|---|---|---|---|
| 18 | 18 | SP | Behenyl acrylate | 20.0 | Methacrylonitrile | 53.0 | Styrene | 17.0 |
| | | | Stearyl acrylate | 10.0 | | | | |
| 19 | 19 | SP | Behenyl acrylate | 11.4 | Acrylonitrile | 56 | Styrene | 31.2 |
| | | | | | Monomer having urethane group | 1.4 | | |
| 20 | 20 | SP | Behenyl acrylate | 11.4 | Acrylonitrile | 56.3 | Styrene | 31.3 |
| | | | | | Monomer having urea group | 1.0 | | |
| 21 | 21 | SP | Behenyl acrylate | 28.9 | Methacrylonitrile | 53.8 | Styrene | 17.3 |
| 22 | 22 | SP | Behenyl acrylate | 28.9 | Methacrylonitrile | 53.8 | Styrene | 17.3 |
| 23 | 23 | SP | Behenyl acrylate | 28.9 | Methacrylonitrile | 53.8 | Styrene | 17.3 |
| 24 | 24 | SP | Behenyl acrylate | 28.9 | Methacrylonitrile | 53.8 | Styrene | 17.3 |
| 25 | 25 | SP | Behenyl acrylate | 28.9 | Methacrylonitrile | 53.8 | Styrene | 17.3 |
| 26 | 26 | SP | Behenyl acrylate | 58.8 | Methacrylonitrile | 41.2 | — | — |
| 27 | 27 | SP | Behenyl acrylate | 28.9 | Methacrylonitrile | 53.8 | Styrene | 17.3 |
| 28 | 28 | SP | Behenyl acrylate | 28.9 | Methacrylonitrile | 53.8 | Styrene | 17.3 |
| 29 | 29 | EA | Behenyl acrylate | 28.9 | Methacrylonitrile | 53.8 | Styrene | 17.3 |
| 30 | 30 | DS | Behenyl acrylate | 28.9 | Methacrylonitrile | 53.8 | Styrene | 17.3 |
| 31 | 31 | P | Behenyl acrylate | 28.9 | Methacrylonitrile | 53.8 | Styrene | 17.3 |
| 32 | 32 | EA | Behenyl acrylate | 28.9 | Methacrylonitrile | 53.8 | Styrene | 17.3 |
| 33 | 33 | EA | Behenyl acrylate | 28.9 | Methacrylonitrile | 53.8 | Styrene | 17.3 |
| 34 | 34 | EA | Behenyl acrylate | 28.9 | Methacrylonitrile | 53.8 | Styrene | 17.3 |
| 35 | 35 | SP | Behenyl acrylate | 14.3 | Methacrylonitrile | 54.1 | Styrene | 17.4 |
| | | | Behenyl methacrylate | 14.2 | | | | |
| 36 | 36 | SP | Behenyl acrylate | 7.0 | Vinyl acetate | 93.0 | — | — |
| C. E. 1 | C. 1 | SP | Behenyl acrylate | 33.2 | Acrylic acid | 12.6 | Methyl methacrylate | 54.2 |
| C. E. 2 | C. 2 | SP | Behenyl acrylate | 61.3 | Methacrylonitrile | 38.7 | — | — |
| C. E. 3 | C. 3 | SP | Behenyl acrylate | 28.0 | Methacrylonitrile | 18.2 | Styrene | 53.8 |
| C. E. 4 | C. 4 | SP | Hexadecyl acrylate | 28.6 | Methacrylonitrile | 54.0 | Styrene | 17.4 |
| C. E. 5 | C. 5 | SP | Behenyl acrylate | 28.5 | — | — | Styrene | 19.1 |
| | | | | | | | Methyl methacrylate | 52.4 |
| C. E. 6 | C. 6 | SP | Behenyl acrylate | 28.9 | Methacrylonitrile | 53.8 | Styrene | 17.3 |

In the Table, C.E. denotes "comparative example", C. denotes "comparative", SP denotes "Suspension polymerization", EA denotes "Emulsion aggregation" DS denotes "Dissolution and suspension", and P denotes "Pulverization".

TABLE 2-2

| Example No. | Toner No. | Manufacturing method | Polymer A: $SP_{21}$-$SP_{11}$ Unit | $SP_{22}$-$SP_{12}$ monomer | Molecular weight Mw | Melting point ° C. | Release agent: Molecular weight Mp | Type | Proportion of polymer A in binder resin mass % |
|---|---|---|---|---|---|---|---|---|---|
| 1 | 1 | SP | 7.71 | 4.28 | 56000 | 62 | 2700 | AH | 100 |
| 2 | 2 | SP | 7.71 | 4.28 | 54200 | 55 | 2700 | AH | 100 |
| 3 | 3 | SP | 7.71 | 4.28 | 54800 | 62 | 2700 | AH | 100 |
| 4 | 4 | SP | 7.71 | 4.28 | 53900 | 57 | 2700 | AH | 100 |
| 5 | 5 | SP | 7.71 | 4.28 | 57800 | 56 | 2700 | AH | 100 |
| 6 | 6 | SP | 7.71 | 4.28 | 53400 | 53 | 2700 | AH | 100 |
| 7 | 7 | SP | 11.19 | 5.05 | 55500 | 62 | 2700 | AH | 100 |
| 8 | 8 | SP | 5.87 | 4.36 | 53400 | 59 | 2700 | AH | 100 |
| 9 | 9 | SP | 3.35 | 0.61 | 53600 | 56 | 2700 | AH | 100 |
| 10 | 10 | SP | 3.35 | 0.61 | 54700 | 54 | 2700 | AH | 100 |
| 11 | 11 | SP | 21.01 | 11.43 | 56800 | 59 | 2700 | AH | 100 |
| 12 | 12 | SP | 10.47 | 4.97 | 57100 | 57 | 2700 | AH | 100 |
| 13 | 13 | SP | 7.57 | 4.25 | 55400 | 54 | 2700 | AH | 100 |
| 14 | 14 | SP | 7.88 | 4.32 | 51800 | 76 | 2700 | AH | 100 |
| 15 | 15 | SP | 7.85 | 4.32 | 53400 | 78 | 2700 | AH | 100 |
| 16 | 16 | SP | 7.71 | 4.28 | 55900 | 58 | 2700 | AH | 100 |
| | | | 10.47 | 4.97 | | | | | |
| 17 | 17 | SP | 7.71 | 4.28 | 52900 | 61 | 2700 | AH | 100 |
| | | | 10.47 | 4.97 | | | | | |
| 18 | 18 | SP | 7.67 | 4.27 | 53800 | 58 | 2700 | AH | 100 |
| 19 | 19 | SP | 11.19 | 5.05 | 53600 | 55 | 2700 | AH | 100 |
| | | | 5.54 | 4.21 | | | | | |

TABLE 2-2-continued

| Example No. | Toner No. | Manufacturing method | Polymer A $SP_{21}$-$SP_{11}$ Unit | Polymer A $SP_{22}$-$SP_{12}$ monomer | Polymer A Molecular weight Mw | Polymer A Melting point ° C. | Release agent Molecular weight Mp | Release agent Type | Proportion of polymer A in binder resin mass % |
|---|---|---|---|---|---|---|---|---|---|
| 20 | 20 | SP | 11.19<br>3.50 | 5.05<br>3.17 | 55400 | 55 | 2700 | AH | 100 |
| 21 | 21 | SP | 7.71 | 4.28 | 56000 | 61 | 1700 | AH | 100 |
| 22 | 22 | SP | 7.71 | 4.28 | 56000 | 62 | 2000 | AH | 100 |
| 23 | 23 | SP | 7.71 | 4.28 | 56000 | 62 | 4600 | AH | 100 |
| 24 | 24 | SP | 7.71 | 4.28 | 56000 | 57 | 1100 | Ester | 100 |
| 25 | 25 | SP | 7.71 | 4.28 | 56000 | 58 | 1700 | Ester | 100 |
| 26 | 26 | SP | 7.71 | 4.28 | 56000 | 58 | 1700 | Ester | 100 |
| 27 | 27 | SP | 7.71 | 4.28 | 56000 | 62 | 2700 | AH | 100 |
| 28 | 28 | SP | 7.71 | 4.28 | 56000 | 62 | 2700 | AH | 100 |
| 29 | 29 | EA | 7.71 | 4.28 | 68400 | 62 | 2700 | AH | 100 |
| 30 | 30 | DS | 7.71 | 4.28 | 68400 | 62 | 2700 | AH | 100 |
| 31 | 31 | P | 7.71 | 4.28 | 68400 | 62 | 2700 | AH | 100 |
| 32 | 32 | EA | 7.71 | 4.28 | 68400 | 62 | 2700 | AH | 82 |
| 33 | 33 | EA | 7.71 | 4.28 | 68400 | 62 | 2700 | AH | 52 |
| 34 | 34 | EA | 7.71 | 4.28 | 68400 | 62 | 2700 | AH | 48 |
| 35 | 35 | SP | 7.79 | 4.32 | 56400 | 62 | 2700 | AH | 100 |
| 36 | 36 | SP | 3.35 | 0.62 | 53600 | 59 | 2700 | AH | 100 |
| C. E. 1 | C. 1 | SP | 10.47 | 4.97 | 52700 | 56 | 530 | AH | 100 |
| C. E. 2 | C. 2 | SP | 7.71 | 4.28 | 55800 | 62 | 2700 | AH | 100 |
| C. E. 3 | C. 3 | SP | 7.71 | 4.28 | 52900 | 56 | 2700 | AH | 100 |
| C. E. 4 | C. 4 | SP | 7.49 | 4.23 | 52200 | 45 | 2700 | AH | 100 |
| C. E. 5 | C. 5 | SP | — | — | 56500 | 52 | 2700 | AH | 100 |
| C. E. 6 | C. 6 | SP | 7.71 | 4.28 | 56000 | 58 | 820 | Ester | 100 |

In the Table, C.E. denotes "comparative example", C. denotes "comparative", SP denotes "Suspension polymerization", EA denotes "Emulsion aggregation" DS denotes "Dissolution and suspension", P denotes "Pulverization", and AH denotes "aliphatic hydrocarbon".

TABLE 3

| | | SP value of polymerizable monomer $(J/cm^3)^{0.5}$ | SP value of monomer unit $(J/cm^3)^{0.5}$ |
|---|---|---|---|
| First polymerizable monomer | Behenyl acrylate | 17.69 | 18.25 |
| | Behenyl methacrylate | 17.61 | 18.10 |
| | Stearyl acrylate | 17.71 | 18.39 |
| | Myricyl acrylate | 17.65 | 18.08 |
| | Octacosyl acrylate | 17.65 | 18.10 |
| | Hexadecyl acrylate | 17.73 | 18.47 |
| Second polymerizable monomer | Acrylonitrile | 22.75 | 29.43 |
| | Methacrylonitrile | 21.97 | 25.96 |
| | Acrylic acid | 22.66 | 28.72 |
| | Methacrylic acid | 21.95 | 25.65 |
| | 2-hydroxypropyl methacrylate | 22.05 | 24.12 |
| | Vinyl acetate | 18.31 | 21.60 |
| | Methyl acrylate | 18.31 | 21.60 |
| | Acrylamide | 29.13 | 39.25 |

TABLE 3-continued

| | | SP value of polymerizable monomer $(J/cm^3)^{0.5}$ | SP value of monomer unit $(J/cm^3)^{0.5}$ |
|---|---|---|---|
| | Monomer having urethane group | 21.91 | 23.79 |
| | Monomer having urea group | 20.86 | 21.74 |
| Third polymerizable monomer | Styrene | 17.94 | 20.11 |
| | Methyl methacrylate | 18.27 | 20.31 |

Examples 2 to 26, 35, 36

Toner particles 2 to 26, 35 and 36 were obtained as in the Example 1 except that the types and added amounts of the monomer compositions and release agents used were changed as shown in Table 1. The types of release agents are shown in Table 4.

External addition was also performed as in the Example 1 to obtain toners 2 to 26, 35 and 36. The physical characteristics are shown in Tables 2-1 and 2-2, and the evaluation results in Table 7.

TABLE 4

| | Name | Type | Molecular weight Mp | Melting point [° C.] |
|---|---|---|---|---|
| Release agent 1 | Excerex 30050B | Aliphatic hydrocarbon | 2700 | 91 |
| Release agent 2 | Excerex 15341PA | Aliphatic hydrocarbon | 1700 | 89 |
| Release agent 3 | Mitsui Hi-Wax 200P | Aliphatic hydrocarbon | 2000 | 122 |
| Release agent 4 | Excerex 48070B | Aliphatic hydrocarbon | 4600 | 90 |
| Release agent 5 | Ester wax of pentaerythritol and palmitic acid | Ester | 1100 | 73 |
| Release agent 6 | Ester wax of dipentaerythritol and palmitic acid | Ester | 1700 | 76 |

TABLE 4-continued

| Name | Type | Molecular weight Mp | Melting point [° C.] |
|---|---|---|---|
| Release agent 7 HNP10 | Aliphatic hydrocarbon | 530 | 76 |
| Release agent 8 Carnauba wax | Ester | 820 | 83 |

Release agents 1 to 4: Mitsui Chemicals, Inc.
Release agent 7: Nippon Seiro Co., Ltd.

Example 27

Toner 27 was obtained by dry mixing 1.8 parts of the silica fine particle 2 and 0.3 parts of the silica particle with 100.0 parts of the toner particle 27 for 5 minutes in a Henschel mixer (Mitsui Mining). The physical properties of the resulting toner 27 are shown in Tables 2-1 and 2-2, and the evaluation results in Table 7.

Example 28

Toner 28 was obtained by dry mixing 1.8 parts of the silica fine particle 1 with 100.0 parts of the toner particle 28 for 5 minutes in a Henschel mixer (Mitsui Mining). The physical properties of the resulting toner 28 are shown in Tables 2-1 and 2-2, and the evaluation results in Table 7.

Example 35

Toner 35 was obtained by dry mixing 1.8 parts of the silica fine particle 1 and 0.3 parts of the silica particle with 100.0 parts of the toner particle 35 for 5 minutes in a Henschel mixer (Mitsui Mining). The physical properties of the resulting toner 35 are shown in Tables 2-1 and 2-2, and the evaluation results in Table 7.

TABLE 5

| Example No. | Toner particle No. | Silica fine particle No. | Silica fine particle Oil treatment | Silica particle | $SP_3$-$SP_w$ |
|---|---|---|---|---|---|
| 1 | 1 | 1 | Yes | Yes | 2.53 |
| 2 | 2 | 1 | Yes | Yes | 4.04 |
| 3 | 3 | 1 | Yes | Yes | 1.52 |
| 4 | 4 | 1 | Yes | Yes | 1.93 |
| 5 | 5 | 1 | Yes | Yes | 5.17 |
| 6 | 6 | 1 | Yes | Yes | 2.55 |
| 7 | 7 | 1 | Yes | Yes | 3.20 |
| 8 | 8 | 1 | Yes | Yes | 3.18 |
| 9 | 9 | 1 | Yes | Yes | 1.78 |
| 10 | 10 | 1 | Yes | Yes | 1.78 |
| 11 | 11 | 1 | Yes | Yes | 4.71 |
| 12 | 12 | 1 | Yes | Yes | 2.03 |
| 13 | 13 | 1 | Yes | Yes | 2.63 |
| 14 | 14 | 1 | Yes | Yes | 2.39 |
| 15 | 15 | 1 | Yes | Yes | 2.42 |
| 16 | 16 | 1 | Yes | Yes | 2.23 |
| 17 | 17 | 1 | Yes | Yes | 2.67 |
| 18 | 18 | 1 | Yes | Yes | 2.56 |
| 19 | 19 | 1 | Yes | Yes | 4.24 |
| 20 | 20 | 1 | Yes | Yes | 4.24 |
| 21 | 21 | 1 | Yes | Yes | 2.55 |
| 22 | 22 | 1 | Yes | Yes | 2.67 |
| 23 | 23 | 1 | Yes | Yes | 2.59 |
| 24 | 24 | 1 | Yes | Yes | 1.68 |
| 25 | 25 | 1 | Yes | Yes | 1.60 |
| 26 | 26 | 1 | Yes | Yes | 0.59 |
| 27 | 27 | 2 | No | Yes | 2.53 |
| 28 | 28 | 1 | Yes | No | 2.53 |
| 29 | 29 | 1 | Yes | Yes | 2.53 |
| 30 | 30 | 1 | Yes | Yes | 2.53 |

TABLE 5-continued

| Example No. | Toner particle No. | Silica fine particle No. | Silica fine particle Oil treatment | Silica particle | $SP_3$-$SP_w$ |
|---|---|---|---|---|---|
| 31 | 31 | 1 | Yes | Yes | 2.53 |
| 32 | 32 | 1 | Yes | Yes | 2.53 |
| 33 | 33 | 1 | Yes | Yes | 2.53 |
| 34 | 34 | 1 | Yes | Yes | 2.53 |
| 35 | 35 | 1 | Yes | Yes | 2.47 |
| 36 | 36 | 1 | Yes | Yes | 3.09 |
| C. E. 1 | C. 1 | 1 | Yes | Yes | 2.60 |
| C. E. 2 | C. 2 | 1 | Yes | Yes | 1.45 |
| C. E. 3 | C. 3 | 1 | Yes | Yes | 1.83 |
| C. E. 4 | C. 4 | 1 | Yes | Yes | 2.47 |
| C. E. 5 | C. 5 | 1 | Yes | Yes | 1.46 |
| C. E. 6 | C. 6 | 1 | Yes | Yes | 2.49 |

In the Table, C.E. denotes "comparative example", C. denotes "comparative".

Example 29

| Preparation of Toner by Emulsion Aggregation<br>Preparation of Polymer Dispersion | |
|---|---|
| Toluene | 300.0 parts |
| Polymer A0 | 100.0 parts |

These materials were weighed precisely, mixed, and dissolved at 90° C.

Separately, 5.0 parts of sodium dodecylbenzenesulfonate and 10.0 parts of sodium laurate were added to 700.0 parts of ion-exchanged water, and heated and dissolved at 90° C. The previous toluene solution was then mixed with the aqueous solution, and stirred at 7,000 rpm with a T. K. Robomix ultra high-speed mixer (Primix). This was emulsified under 200 MPa of pressure with a Nanomizer high-pressure impact disperser (Yoshida Kikai). The toluene was then removed with an evaporator, and the concentration was adjusted with ion-exchanged water to obtain a polymer dispersion with a polymer fine particle concentration of 20%.

The 50% volume-based particle diameter (D50) of the polymer fine particle was 0.40 μm as measured with a Nanotrac UPA-EX150 dynamic light scattering particle size distribution meter (Nikkiso).

| Preparation of Release Agent Dispersion 1 | |
|---|---|
| Release agent 1 | 100.0 parts |
| Neogen RK anionic surfactant (Daiichi Kogyo Seiyaku) | 5.0 parts |
| Ion-exchanged water | 395.0 parts |

These materials were weighed precisely, loaded into a mixing vessel with an attached stirring device, heated to 90°

C., and then dispersed for 60 minutes by recirculating into a Clearmix W-Motion (M Technique). The dispersion conditions were as follows.

| | |
|---|---|
| Outer rotor diameter | 3 cm |
| Clearance | 0.3 mm |
| Rotor speed | 19,000 r/min |
| Screen rotation | 19,000 r/min |

After being dispersed, this was cooled to 40° C. under conditions of rotor speed 1,000 r/min, screen rotation 0 r/min, cooling speed 10° C./min to obtain a release agent dispersion 1 having a concentration of 20% of the release agent fine particle 1.

The 50% volume-based particle diameter (D50) of the release agent fine particle 1 was 0.15 μm as measured with a Nanotrac UPA-EX150 dynamic light scattering particle size distribution meter (Nikkiso).

| Preparation of Colorant Dispersion 1 | |
|---|---|
| Colorant (Cyan pigment, Dainichi Seika Pigment Blue 15:3) | 50.0 parts |
| Neogen RK anionic surfactant (Daiichi Kogyo Seiyaku) | 7.5 parts |
| Ion-exchanged water | 442.5 parts |

These materials were weighed precisely, mixed, dissolved, and dispersed for 1 hour with a with a Nanomizer high-pressure impact disperser (Yoshida Kikai) to disperse the colorant and obtained a colorant dispersion 1 having a concentration of 10% of the colorant fine particle 1.

The 50% volume-based particle diameter (D50) of the colorant fine particle 1 was 0.20 μm as measured with a Nanotrac UPA-EX150 dynamic light scattering particle size distribution meter (Nikkiso).

| Manufacture of Toner 29 | |
|---|---|
| Polymer dispersion | 500.0 parts |
| Release agent dispersion 1 | 50.0 parts |
| Colorant dispersion 1 | 80.0 parts |
| Ion-exchanged water | 160.0 parts |

These materials were loaded into a round-bottomed stainless steel flask, and mixed. This was then dispersed for 10 minutes at 5,000 r/min with an Ultra Turrax T50 homogenizer (IKA). 1.0% aqueous nitric acid solution was added to adjust the pH to 3.0, after which the mixture was heated to 58° C. in a heating water bath using a stirring blade while adjusting number of rotations so that the mixture could be stirred. The volume-average particle diameter of the resulting aggregated particles was checked appropriately with a Coulter Multisizer III, and once aggregated particles with a weight-average particle diameter (D4) of 6.0 μm had formed, the pH was adjusted to 9.0 with a 5% sodium hydroxide aqueous solution. Stirring was then continued as the mixture was heated to 75° C. This was then maintained at 75° C. for 1 hour to fuse the aggregated particles.

This was then cooled to 50° C., and maintained for 3 hours to promote crystallization of the polymer.

This was then cooled to 25° C., subjected to filtration and solid-liquid separation, and washed with ion-exchanged water. After completion of washing it was dried with a vacuum drier to obtain a toner particle 29 with a weight-average particle diameter (D4) of 6.07 μm.

External addition to the toner particle 29 was performed as in Example 1 to obtain a toner 29. The physical properties of the toner 29 are shown in Tables 2-1 and 2-2, and the evaluation results in Table 7.

Example 30

Preparation of Toner by Dissolution and Suspension

Preparation of Fine Particle Dispersion 1

683.0 parts of water, 11.0 parts of a sodium salt of methacrylic acid ethylene oxide (EO) adduct sulfate ester (Eleminol RS-30, Sanyo Chemical), 130.0 parts of styrene, 138.0 parts of methacrylic acid, 184.0 parts of n-butyl acrylate and 1.0 part of ammonium persulfate were loaded into a reactor with an attached stirring bar and thermometer, and stirred at 400 rpm for 15 minutes to obtain a white suspension. This was heated to raise the temperature inside the system to 75° C., and reacted for 5 hours.

A further 30.0 parts of a 1% ammonium persulfate aqueous solution were added, and this was cured for 5 hours at 75° C. to obtain a vinyl polymer fine particle dispersion 1. The volume-based 50% particle diameter (D50) of the fine particle dispersion 1 was found to be 0.15 μm as measured with a Nanotrac UPA-EX150 dynamic light scattering particle size distribution meter (Nikkiso).

| Preparation of Colorant Dispersion 2 | |
|---|---|
| C.I. pigment blue 15:3 | 100.0 parts |
| Ethyl acetate | 150.0 parts |
| Glass beads (1 mm) | 200.0 parts |

These materials were placed in a heat-resistant glass vessel, and dispersed for 5 hours with a pain shaker, and the glass beads were removed with a nylon mesh to obtain a colorant dispersion 2. The 50% volume-based particle diameter (D50) of the colorant dispersion was 0.20 μm as measured with a Nanotrac UPA-EX150 dynamic light scattering particle size distribution meter (Nikkiso).

| Preparation of Release Agent Dispersion 2 | |
|---|---|
| Release agent 1 | 20.0 parts |
| Ethyl acetate | 80.0 parts |

These were placed in a sealable reactor, and heated and stirred at 80° C. The system was then cooled to 25° C. over the course of 3 hours under gentle stirring at 50 rpm to obtain a milky white liquid.

This solution was placed in a heat-resistant container together with 30.0 mass parts of glass beads 1 mm in diameter, and dispersed for 3 hours with a paint shaker (Toyo Seiki), and the glass beads were removed with a nylon mesh to obtain a release agent dispersion 2. The 50% volume-based particle diameter (D50) of the release agent dispersion 2 was 0.23 μm as measured with a Nanotrac UPA-EX150 dynamic light scattering particle size distribution meter (Nikkiso).

| Preparation of Oil Phase | |
|---|---|
| Polymer A0 | 100.0 parts |
| Ethyl acetate | 85.0 parts |

These materials were placed in a beaker and stirred for 1 minute at 3,000 rpm with a Disper (Tokushu Kika).

| | |
|---|---|
| Release agent dispersion 2 (solids 20%) | 50.0 parts |
| Colorant dispersion 2 (solids 40%) | 12.5 parts |
| Ethyl acetate | 5.0 parts |

These materials were then placed in a beaker and stirred for 3 minutes at 6,000 rpm with a Disper (Tokushu Kika) to prepare an oil phase.

| Preparation of Water Phase | |
|---|---|
| Fine particle dispersion 1 | 15.0 parts |
| Dodecyl diphenyl ether sodium disulfonate aqueous solution (Eleminol MON7, Sanyo Chemical Industries) | 30.0 parts |
| Ion-exchanged water | 955.0 parts |

These materials were placed in a beaker, and stirred for 3 minutes at 3,000 rpm with a Disper (Tokushu Kika) to prepare a water phase.

Manufacture of Toner 30

The oil phase was added to the water phase, and dispersed for 10 minutes at 10,000 rpm with a TK Homogenizer (Tokushu Kika). The solvent was then removed for 30 minutes at 30° C. under reduced pressure of 50 mmHg. This was then filtered, and the operations of filtration and re-dispersal in ion-exchanged water were repeated until the conductivity of the slurry was 100 μS, to remove the surfactant and obtain a filtrate cake.

This filtrate cake was vacuum dried, and then air classified to obtain a toner particle 30.

External addition to the toner particle 30 was performed as in the Example 1 to obtain a toner 30. The physical characteristics of the toner 30 are shown in Tables 2-1 and 2-2, and the evaluation results in Table 7.

Example 31

| Preparation of Toner by Pulverization | |
|---|---|
| Polymer A0 | 100.0 parts |
| C.I. pigment blue 15:3 | 6.5 parts |
| Release agent 1 | 2.0 parts |
| Charge control agent (T-77: Hodogaya Chemical) | 2.0 parts |

These materials were pre-mixed in an FM mixer (Nippon Coke & Engineering), and melt kneaded with a twin-screw kneading extruder (Ikegai Corp. PCM-30).

The resulting kneaded product was cooled, coarsely pulverized in a hammer mill and then pulverized in a mechanical pulverizer (Turbo Industries T-250), and the resulting fine powder was classified with a with a multi-division classifier using the Coanda effect to obtain a toner particle 31 with a weight-average particle diameter (D4) of 7.0 μm.

External addition to the toner particle 31 was performed as in the Example 1 to obtain a toner 31. The physical characteristics of the toner 31 are shown in Tables 2-1 and 2-2, and the evaluation results in Table 7.

Examples 32 to 34

| Preparation of Amorphous Resin Dispersion | |
|---|---|
| Toluene | 300.0 parts |
| Amorphous resin | 100.0 parts |

These materials were weighed precisely, mixed, and dissolved at 90° C.

Separately, 5.0 parts of sodium dodecylbenzenesulfonate and 10.0 parts of sodium laurate were added to 700.0 parts of ion-exchanged water, and heated to dissolve at 90° C. The previous toluene solution was then mixed with the aqueous solution, and stirred at 7,000 rpm with a T. K. Robomix ultra high-speed mixer (Primix). This was further emulsified under 200 MPa of pressure with a Nanomizer high-pressure impact disperser (Yoshida Kikai). The toluene was then removed with an evaporator, and the concentration was adjusted with ion-exchanged water to obtain an amorphous resin dispersion with a concentration of 20% of the amorphous resin fine particle.

The 50% volume-based particle diameter (D50) of the amorphous resin fine particle was 0.38 μm as measured with a Nanotrac UPA-EX150 dynamic light scattering particle size distribution meter (Nikkiso).

Manufacture of Toners 32 to 34

Toner particles 32 to 34 were obtained as in the manufacturing example of the toner 29 except that the amounts of the dispersions used were changed as shown in Table 6.

External addition to the toner particles 32 to 34 was also performed as in the manufacturing example of the toner 29 to obtain toners 32 to 34. The physical properties are shown in Tables 2-1 and 2-2, and the evaluation results in Table 7.

TABLE 6

| | Polymer dispersion parts | Amorphous resin dispersion parts | Release agent dispersion parts | Colorant dispersion parts |
|---|---|---|---|---|
| Example 29 | 500.0 | — | 50.0 | 80.0 |
| Example 32 | 410.0 | 90.0 | 50.0 | 80.0 |
| Example 33 | 260.0 | 240.0 | 50.0 | 80.0 |
| Example 34 | 240.0 | 260.0 | 50.0 | 80.0 |

Comparative Examples 1 to 6

Comparative toner particles 1 to 6 were obtained as in Example 1 in all respects except that the types and added amounts of the monomer compositions and release agent were changed as shown in Table 1.

Comparative toners 1 to 6 were then obtained as in Example 1 in all respects except that the types and added amounts of the external additives used were changed as shown in Table 5.

The physical properties of the Comparative toners 1 to 6 are shown in Tables 2-1 and 2-2, and the evaluation results in Table 7.

Toner Evaluation Methods

<1> Low-Temperature Fixability

A process cartridge filled with the toner was left for 48 hours in a normal temperature, normal humidity (N/N) environment (23° C., 60% RH). Using an LBP-7700C that had been modified to operate even with the fixing unit removed, an unfixed image was output with an image pattern consisting of 10 mm×10 mm square images arranged at 9 points uniformly across the entire transfer paper. The toner laid-on level on the transfer paper was set at 0.80 mg/cm', and the fixing onset temperature was evaluated. Fox River Bond (90 g/m$^2$) was used as the transfer paper.

The fixing unit was a fixing unit that was removed from the LBP-7700C and made to operate as an external fixing unit outside the laser beam printer. Fixing was performed with the external fixing unit at a process speed of 240 mm/sec with the fixing temperature raised in 10° C. increments from 100° C.

The fixed images were rubbed with Silbon paper (Lenz Cleaning Paper "dasper (R)", Ozu Paper Co., Ltd.) under a load of 50 g/cm$^2$. The temperature at which the density decrease after rubbing was 20% or less was given as the fixing initiation temperature, and low-temperature fixability was evaluated according to the following standard. The evaluation results are shown in Table 7.

Evaluation Standard

A: Fixing initiation temperature 100° C.
B: Fixing initiation temperature 110° C.
C: Fixing initiation temperature 120° C.
D: Fixing initiation temperature 130° C.
E: Fixing initiation temperature at least 140° C.

<2> Heat-Resistant Storage Stability

Heat-resistant storage stability was evaluated to evaluate stability during storage. 6 g of toner was placed in a 100 mL resin cup, and left for 10 days at 50° C., 20% RH, and the degree of aggregation of the toner was measured as follows and evaluated according to the following standard.

For the measurement unit, a digital display vibration meter (Digivibro Model 1332A, Showa Sokki) was connected to the shaking table side part of a Powder Tester (Hosokawa Micron). A 38 μm (400 mesh) screen, a 75 μm (200 mesh) screen and a 150 μm (100 mesh) screen were then set on the Powder Tester shaking table in that order from bottom to top. Measurement was performed as follows at 23° C., 60% RH.

(1) The vibration width of the shaking table was adjusted in advance so that the displacement value of the digital display vibration meter was 0.60 mm (peak-to-peak).

(2) Toner that had been left for 10 days as described above was left for 24 hours in advance in a 23° C., 60% RH environment, and 5 g of this toner was weighed exactly and placed gently on the upper 150 μm screen.

(3) The screens were vibrated for 15 seconds, the mass of the toner remaining on each screen was measured, and aggregation was calculated based on the following formula. The evaluation results are shown in Table 7.

Aggregation (%)={(sample mass (g) on 150 μm screen)/5 (g)}×100+{(sample mass (g) on 75 μm screen)/5 (g)}×100×0.6+{(sample mass (g) on 38 μm screen)/5 (g)}×100×0.2

The evaluation standard is as follows.

A: Aggregation less than 20%
B: Aggregation from 20% to less than 25%
C: Aggregation from 25% to less than 30%
D: Aggregation from 30% to less than 35%
E: Aggregation at least 35%

<3> Release Properties

The previous printer was used as the evaluation unit, and GF-500 (A4, basis weight 64.0 g/m$^2$, sold by Canon Marketing Japan) as the evaluation paper. The paper feed direction was vertical. An unfixed image was prepared 100 mm wide beginning 1 mm from the leading edge of the evaluation paper in the direction of feed and 200 mm wide in the direction perpendicular to the direction of feed. The toner laid-on level of the unfixed image was 1.2 mg/cm$^2$.

Using the fixing unit described above, the temperature was raised in 10° C. increments beginning at the fixing onset temperature from the low-temperature fixability evaluation, and winding of the fixed image around the fixing roller was measured. The temperature range at which winding did not occur was evaluated according to the following standard.

The evaluation results are shown in Table 7.

Evaluation Standard

A: Temperature range without winding: 40° C. or higher
B: Temperature range without winding: 30° C.
C: Temperature range without winding: 20° C.
D: Temperature range without winding: 10° C.
E: Winding occurs at all temperature ranges <4> Durability Durability was evaluated using a commercial Canon LBP9200C printer. The LBP9200C uses one-component contact development, and the amount of toner on the developing carrier is regulated by a toner regulating member. For the evaluation cartridge, the toner was removed from a commercial cartridge, the inside was cleaned by air blowing, and the cartridge was filled with 260 g of the toner for evaluation. This cartridge was installed in the cyan station, and the evaluation was performed with dummy cartridges in the other stations.

Using Fox River Bond (90 g/m$^2$) in a 23° C., 60% RH environment, images were continuously output with a print percentage of 1%. A solid image and a halftone image were output every 1,000 sheets, and the presence or absence of vertical streaks (so-called developing streaks) due to toner adhesion to the regulating member was confirmed with the naked eye. 20,000 sheets were ultimately output. The evaluation results are shown in Table 7.

Evaluation Standard

A: No streaks even in 20,000 sheets
B: Streaks in 20,000 sheets
C: Streaks in 18,000 or 19,000 sheets
D: Streaks in 17,000 sheets or less <5> Gloss The gloss value was measured at any 3 points on the image under conditions of light incidence angle 75° using a PG-3D portable gloss meter (Nippon Denshoku) in an image similar to that used in evaluation <1> at a temperature 20° C. higher than the fixing initiation temperature in evaluation <1>, and the average of the 3 points was given as the gloss value. The evaluation results are shown in Table 7.

Evaluation Standard

A: Gloss value at least 25
B: Gloss value from 20 to less than 25
C: Gloss value from 15 to less than 20
D: Gloss value less than 15

TABLE 7

| Example No. | Toner No. | Low-temperature fixability | Heat-resistant storability | Release properties | Durability | Gloss |
|---|---|---|---|---|---|---|
| 1 | 1 | A | A | A | A | A |
| 2 | 2 | C | C | A | A | A |
| 3 | 3 | A | A | A | C | A |
| 4 | 4 | A | B | A | C | A |
| 5 | 5 | C | B | A | A | A |
| 6 | 6 | C | C | A | C | A |
| 7 | 7 | A | A | A | A | A |
| 8 | 8 | A | B | A | A | A |
| 9 | 9 | A | B | A | A | A |
| 10 | 10 | A | C | A | A | A |

TABLE 7-continued

| Example No. | Toner No. | Low-temperature fixability | Heat-resistant storability | Release properties | Durability | Gloss |
|---|---|---|---|---|---|---|
| 11 | 11 | B | B | A | A | A |
| 12 | 12 | A | C | A | C | A |
| 13 | 13 | A | C | A | A | A |
| 14 | 14 | C | A | A | A | A |
| 15 | 15 | C | A | A | A | A |
| 16 | 16 | A | B | A | A | A |
| 17 | 17 | A | A | A | A | A |
| 18 | 18 | A | B | A | A | A |
| 19 | 19 | C | C | A | A | A |
| 20 | 20 | C | C | A | A | A |
| 21 | 21 | A | A | A | A | A |
| 22 | 22 | C | A | A | A | A |
| 23 | 23 | A | A | A | A | A |
| 24 | 24 | A | B | C | A | A |
| 25 | 25 | A | B | B | A | A |
| 26 | 26 | A | B | C | C | A |
| 27 | 27 | A | A | A | A | C |
| 28 | 28 | A | A | A | C | A |
| 29 | 29 | A | A | A | A | A |
| 30 | 30 | A | A | A | A | A |
| 31 | 31 | A | A | A | A | A |
| 32 | 32 | A | A | A | A | A |
| 33 | 33 | B | A | A | A | A |
| 34 | 34 | C | A | A | A | A |
| 35 | 35 | A | A | A | A | A |
| 36 | 36 | C | A | A | A | A |
| C. E. 1 | C. 1 | A | C | D | D | A |
| C. E. 2 | C. 2 | A | A | A | D | A |
| C. E. 3 | C. 3 | A | C | A | D | A |
| C. E. 4 | C. 4 | A | D | A | A | A |
| C. E. 5 | C. 5 | A | D | A | A | A |
| C. E. 6 | C. 6 | A | B | D | A | A |

In the Table, C.E. denotes "comparative example", C. denotes "comparative".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-113059, filed Jun. 13, 2018, Japanese Patent Application No. 2019-074941, filed Apr. 10, 2019, and Japanese Patent Application No, 2019-094515, filed May 20, 2019, which are hereby incorporated by reference herein in their entirety.

What is claimed is:

1. A toner comprising a toner particle containing a binder resin and a release agent;

the binder resin containing a polymer A that is a polymer obtained by polymerization of a composition containing a first polymerizable monomer and a second polymerizable monomer different from the first polymerizable monomer;

the first polymerizable monomer being at least one selected from the group consisting of (meth)acrylic acid esters having an alkyl group including a carbon number of 18 to 36; and the second polymerizable polymer being at least one monomer selected from the group consisting of an acrylonitrile and a methacrylonitrile, wherein the content of polymer A in the binder resin is at least 50.0 mass %, the content of the first polymerizable monomer in the composition is 5.0 to 40.0 mol % of the total moles of all polymerizable monomers in the composition, the content of the second polymerizable monomer in the composition is 40.0 to 95.0 mol % of the total moles of all polymerizable monomers in the composition, $0.60 \leq (SP_{22}-SP_{12}) \leq 15.00$ when $SP_{12}$ $(J/cm^3)^{0.5}$ is the solubility parameter of the first polymerizable monomer, and $SP_{22}$ $(J/cm^3)^{0.5}$ is the solubility parameter of the second polymerizable monomer, and the molecular weight of the release agent is at least 1,000.

2. The toner according to claim 1, wherein the first polymerizable monomer is at least one monomer selected from the group consisting of (meth)acrylic acid esters having a linear alkyl group including a carbon number of 18-36.

3. The toner according to claim 1, wherein the composition further contains a third polymerizable monomer that is different from the first polymerizable monomer and second polymerizable monomer, and the third polymerizable monomer is at least one monomer selected from the group consisting of styrene, methyl methacrylate and methyl acrylate.

4. The toner according to claim 1, wherein the melting point of the release agent is from 60 to 120° C.

5. The toner according to claim 1, wherein $(SP_3-SP_w) \geq 1.00$ when $SP_3$ $(J/cm^3)^{0.5}$ is the solubility parameter of polymer A and $SP_w$ $(J/cm^3)^{0.5}$ is the solubility parameter of the release agent.

6. The toner according to claim 1, wherein polymer A is a vinyl polymer.

7. The toner according to claim 1, wherein the release agent contains an aliphatic hydrocarbon wax.

8. The toner according to claim 1, wherein the toner has an external additive comprising a silica fine particle treated with silicone oil.

9. The toner according to claim 1, wherein the toner has an external additive comprising a silica particle having a primary particle with a number-average particle diameter of 30 to 500 nm.

* * * * *